US010319354B2

(12) United States Patent
Laughlin et al.

(10) Patent No.: US 10,319,354 B2
(45) Date of Patent: Jun. 11, 2019

(54) MODULATING KEYBOARD WITH RELATIVE TRANSPOSITION MECHANISM FOR ELECTRONIC KEYBOARD MUSICAL INSTRUMENTS

(71) Applicant: Mercurial Modulation, LLC, Media, PA (US)

(72) Inventors: D. Kevin Laughlin, Media, PA (US); James L. Laughlin, Media, PA (US)

(73) Assignee: Mercurial Modulation, LLC, Media, PA (US)

( * ) Notice: Subject to any disclaimer, the term of this patent is extended or adjusted under 35 U.S.C. 154(b) by 0 days.

(21) Appl. No.: 15/668,019

(22) Filed: Aug. 3, 2017

(65) Prior Publication Data

US 2018/0040314 A1 Feb. 8, 2018

Related U.S. Application Data

(60) Provisional application No. 62/370,503, filed on Aug. 3, 2016.

(51) Int. Cl.

*G10H 1/34* (2006.01)
*G10H 1/00* (2006.01)
*G10H 1/20* (2006.01)

(52) U.S. Cl.

CPC ..... *G10H 1/344* (2013.01); *G10H 1/0016* (2013.01); *G10H 1/0066* (2013.01); *G10H 1/20* (2013.01); *G10H 2220/061* (2013.01); *G10H 2220/221* (2013.01); *G10H 2220/251* (2013.01)

(58) Field of Classification Search

CPC ..... G10H 1/20; G10H 2220/251
USPC ..... 84/619, 657, 685, 445
See application file for complete search history.

(56) References Cited

U.S. PATENT DOCUMENTS 3,610,800 A * 10/1971 Deutsch ..... G06F 1/02 84/619
3,674,907 A * 7/1972 Derry ..... G10H 1/20 84/445
4,176,573 A * 12/1979 Deutsch ..... G10C 3/28 84/445
D281,784 S * 12/1985 Tabor ..... D17/9
4,903,572 A 2/1990 Coles
5,083,493 A 1/1992 Heo (Continued)

OTHER PUBLICATIONS

International Search Report and Written Opinion for corresponding International Application No. PCT/US2017/045262, dated Oct. 17, 2017.

(Continued)

*Primary Examiner* — David S Warren
(74) *Attorney, Agent, or Firm* — DLA Piper LLP (US)

(57) ABSTRACT

A modulating keyboard having a relative transposition in an electronic keyboard musical instrument and a method for relative transposition are provided. An instrument includes a keyboard having a plurality of first keys alternating with a plurality of second keys and a modulator system coupled to the keyboard. The modulator system is configured to assign note values to each of the first keys and the second keys such that, for each key signature, notes associated with the key signature are assigned to the plurality of first keys and notes not in the key signature are assigned to the plurality of second keys.

20 Claims, 21 Drawing Sheets

(56) References Cited

U.S. PATENT DOCUMENTS 5,099,738 A * 3/1992 Hotz ..... G10H 1/0075 84/617
5,565,641 A * 10/1996 Gruenbaum ..... G10H 1/0066 84/451
5,619,003 A * 4/1997 Hotz ..... G10H 1/0075 84/615
5,726,374 A * 3/1998 Vandervoort ..... G10H 1/28 84/638
5,864,079 A * 1/1999 Matsuda ..... G10H 1/20 84/619
7,435,891 B2 10/2008 Perla
7,982,118 B1 * 7/2011 Gleaves ..... G10H 1/0025 84/609
8,642,875 B2 * 2/2014 Kinter ..... G10H 1/38 84/619
9,153,219 B1 * 10/2015 Bacigalupo ..... G10H 1/02
9,552,800 B1 * 1/2017 Pogoda ..... G06F 3/03547
2006/0156908 A1 * 7/2006 Yoshinnine ..... G10C 3/12 84/619
2013/0255474 A1 * 10/2013 Hanks ..... G10H 1/342 84/615
2013/0305906 A1 * 11/2013 Kinter ..... G10H 1/38 84/613
2018/0040314 A1 * 2/2018 Laughlin ..... G10H 1/0016
2018/0144730 A1 * 5/2018 Matusiak ..... G10H 1/0025

OTHER PUBLICATIONS

International Preliminary Report on Patentability for corresponding International Application No. PCT/US2017/045262, dated Feb. 14, 2019.

* cited by examiner

| C14 | | | | | | | | | | | |
|---|---|---|---|---|---|---|---|---|---|---|---|
| NOTES | OCTAVES | | | | | | | | | | |
| | -1 | 0 | 1 | 2 | 3 | 4 | 5 | 6 | 7 | 8 | 9 |
| C | 0 | 14 | 28 | 42 | 56 | 70 | 84 | 98 | 112 | 126 | 140 |
| C# | 1 | 15 | 29 | 43 | 57 | 71 | 85 | 99 | 113 | 127 | 141 |
| D | 2 | 16 | 30 | 44 | 58 | 72 | 86 | 100 | 114 | 128 | 142 |
| D# | 3 | 17 | 31 | 45 | 59 | 73 | 87 | 101 | 115 | 129 | 143 |
| E | 4 | 18 | 32 | 46 | 60 | 74 | 88 | 102 | 116 | 130 | 144 |
| EPSILON | 5 | 19 | 33 | 47 | 61 | 75 | 89 | 103 | 117 | 131 | |
| F | 6 | 20 | 34 | 48 | 62 | 76 | 90 | 104 | 118 | 132 | |
| F# | 7 | 21 | 35 | 49 | 63 | 77 | 91 | 105 | 119 | 133 | |
| G | 8 | 22 | 36 | 50 | 64 | 78 | 92 | 106 | 120 | 134 | |
| G# | 9 | 23 | 37 | 51 | 65 | 79 | 93 | 107 | 121 | 135 | |
| A | 10 | 24 | 38 | 52 | 66 | 80 | 94 | 108 | 122 | 136 | |
| A# | 11 | 25 | 39 | 53 | 67 | 81 | 95 | 109 | 123 | 137 | |
| B | 12 | 26 | 40 | 54 | 68 | 82 | 96 | 110 | 124 | 138 | |
| BETA | 13 | 27 | 41 | 55 | 69 | 83 | 97 | 111 | 125 | 139 | |

FIG. 7

| STANDARD MIDI NOTE VALUES | | | | | | | | | | | |
|---|---|---|---|---|---|---|---|---|---|---|---|
| NOTES | OCTAVES | | | | | | | | | | |
| | -1 | 0 | 1 | 2 | 3 | 4 | 5 | 6 | 7 | 8 | 9 |
| C | 0 | 12 | 24 | 36 | 48 | 60 | 72 | 84 | 96 | 108 | 120 |
| C# | 1 | 13 | 25 | 37 | 49 | 61 | 73 | 85 | 97 | 109 | 121 |
| D | 2 | 14 | 26 | 38 | 50 | 62 | 74 | 86 | 98 | 110 | 122 |
| D# | 3 | 15 | 27 | 39 | 51 | 63 | 75 | 87 | 99 | 111 | 123 |
| E | 4 | 16 | 28 | 40 | 52 | 64 | 76 | 88 | 100 | 112 | 124 |
| F | 5 | 17 | 29 | 41 | 53 | 65 | 77 | 89 | 101 | 113 | 125 |
| F# | 6 | 18 | 30 | 42 | 54 | 66 | 78 | 90 | 102 | 114 | 126 |
| G | 7 | 19 | 31 | 43 | 55 | 67 | 79 | 91 | 103 | 115 | 127 |
| G# | 8 | 20 | 32 | 44 | 56 | 68 | 80 | 92 | 104 | 116 | |
| A | 9 | 21 | 33 | 45 | 57 | 69 | 81 | 93 | 105 | 117 | |
| A# | 10 | 22 | 34 | 46 | 58 | 70 | 82 | 94 | 106 | 118 | |
| B | 11 | 23 | 35 | 47 | 59 | 71 | 83 | 95 | 107 | 119 | |

FIG. 8

MODULATING KEYBOARD WITH RELATIVE TRANSPOSITION MECHANISM FOR ELECTRONIC KEYBOARD MUSICAL INSTRUMENTS

TECHNICAL FIELD

The present disclosure relates to electronic keyboard musical instruments and, more particularly, to a modulating keyboard with a relative transposition mechanism for electronic keyboard musical instruments.

BACKGROUND

A conventional keyboard of an electronic keyboard musical instrument includes twelve keys (seven white longer keys and five black shorter keys) in a particular arrangement, for playing the twelve notes of the Western musical scale. The white keys are the seven notes of the C major scale (C, D, E, F, G, A, B), and the black keys represent the notes that are not part of the C major scale (i.e., C#/D flat, D#/E flat, F#/G flat, G#/A flat, A#/B flat). This pattern of white and black keys repeats at the interval of an octave. This type of keyboard has been used on the overwhelming majority of keyboard musical instruments for the past 300 years.

When one plays a conventional keyboard, each key signature on the keyboard appears as a unique series of notes. Because each key signature is unique, creative and seamless movement between keys while playing requires a level of theoretical and keyboard playing technical mastery that few people have ever achieved.

The conventional solution to this problem is the use of direct transposition. Direct transposition changes each and every note on the keyboard by a selected interval. While direct transposition does change the key signature, it may also create difficulties for the player. When the player plays a melodic line and uses direct transposition, the entire line will shift by that interval; thus making it challenging to transpose and play a stepwise melody.

Accordingly, there is a need for improved keyboards and transposition mechanisms that solve these and other problems.

SUMMARY

Aspects of the present disclosure relate to a modulating keyboard having a relative transposition mechanism in an electronic keyboard musical instrument. An electronic keyboard musical instrument includes a keyboard and a modulator system coupled to the keyboard. The keyboard includes a plurality of first keys alternating with a plurality of second keys. The modulator system is configured to assign note values to each of the first keys and the second keys such that, for each key signature, notes associated with the key signature are assigned to the plurality of first keys and notes not in the key signature are assigned to the plurality of second keys. The relative transposition of the instrument only shifts the notes that the current key signature and target key signature do not have in common. This allows a player to play melodies that move through key signature changes seamlessly while constantly maintaining the intuitiveness and ease of fingering a single scale.

Aspects of the present invention also relate to methods and non-transitory computer readable storage medium for transposing an electronic keyboard. The method includes assigning, by a microcontroller coupled to the electronic keyboard, for a current key signature, note values to each of a plurality of first keys of the electronic keyboard, such that notes associated with the current key signature are assigned to the plurality of first keys. The electronic keyboard includes the plurality of first keys alternating with a plurality of second keys. The method further includes assigning, by the microcontroller, for the current key signature, note values to each of the plurality of second keys of the electronic keyboard, such that notes not in the key signature are assigned to the plurality of second keys. The method further includes receiving a selection indicating a transposition to a target key signature; and modifying, by the microcontroller, responsive to the selection, note values assigned to each of the first keys and the second keys according to a relative transposition mapping, to shift one or more notes that the current key signature and the target key signature do not have in common, and such that notes associated with the target key signature are assigned to the plurality of first keys.

BRIEF DESCRIPTION OF THE DRAWINGS

FIG. 7 is an exemplary embodiment of a table of example MIDI note value assignments for octaves in a fourteen note (C14) scale, according to an aspect of the present disclosure.

FIG. 8 is an exemplary embodiment of a table of example MIDI note value assignments for octaves in a twelve note scale, according to an aspect of the present disclosure.

DETAILED DESCRIPTION

Figure 1:
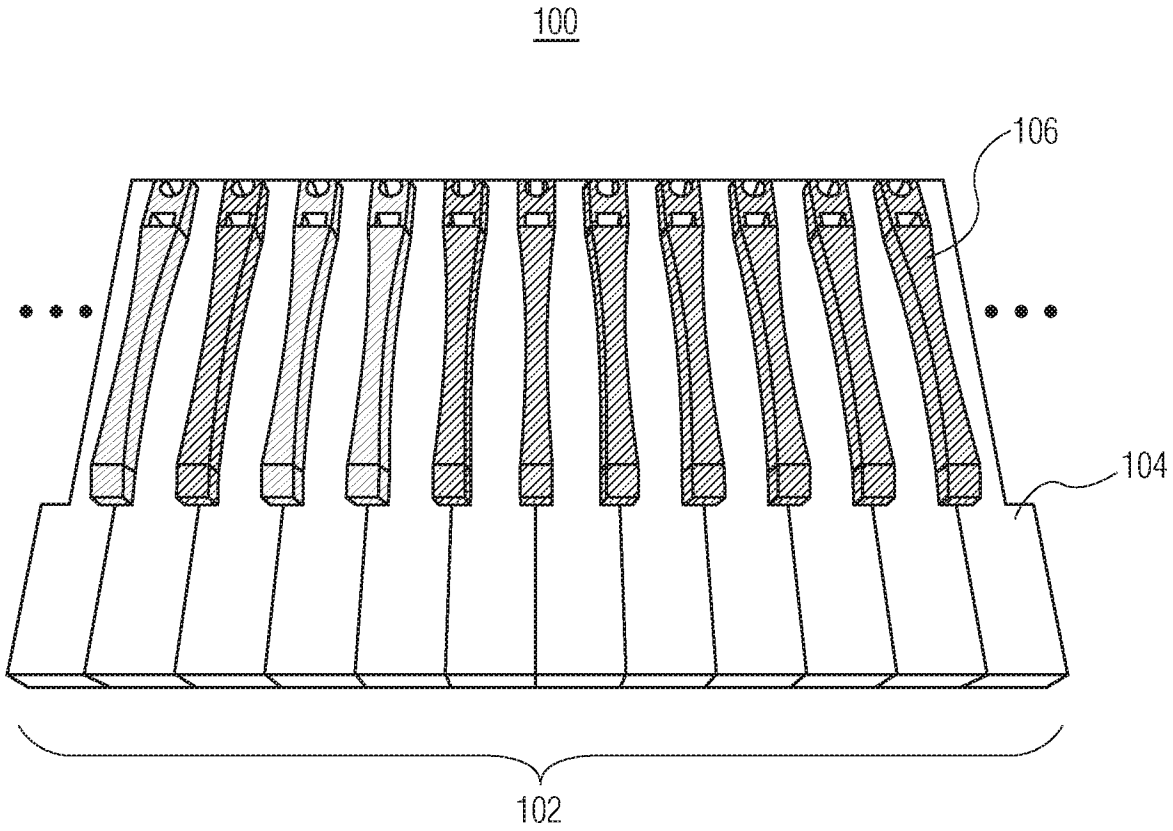
FIG. 1 is an overhead perspective view diagram of an example portion of an exemplary embodiment of a modulating keyboard according to an aspect of the present disclosure.

Aspects of the present disclosure relate to a modulating keyboard of an electronic keyboard musical instrument having alternating first and second keys. The instrument includes a modulation mechanism that performs a relative transposition process, such that notes in each key signature are assigned to the first keys and notes outside of the key signature are assigned to the second keys. The second keys of the keyboard are also configured to indicate, to a player, positions of one or more notes in a scale of the key signature, and a playability of any the second keys based on the key signature.

The term "standard keyboard" refers to a conventional keyboard manual comprised of twelve keys (seven white keys and five black keys) per octave for playing the twelve notes of the Western scale, that has been used on the overwhelming majority of keyboard instruments for the past 300 years. In each octave portion of the conventional ("standard") keyboard, there are two instances where two of the white keys are arranged next to each other, without any black keys therebetween.

The term "modulating keyboard" refers to a keyboard instrument according to the present disclosure that features fourteen keys per octave with alternating equally sized and spaced large (white) and small (clear) keys.

The term "direct transposition" refers to the transposition of each note on the keyboard by the same interval.

The term "current key signature" refers to the key signature being used prior to direct or relative transposition.

The term "target key signature" refers to the key signature being modulated to as a result of transposition.

The term "relative transposition" refers to transposition according to the present disclosure, where the transposition of notes not shared by the current and the target key signatures are transposed by no more than one semi tone up or down to achieve the target key signature.

The term "MIDI generator" refers to a computer chip that is the source of all Musical Instrument Digital Interface (MIDI) note "on", MIDI note "off" and velocity MIDI messages. The MIDI generator also represents all key switches (i.e., on/off).

The term "modulator system" refers to a mechanism including hardware, software or a combination thereof which interprets the output of the MIDI generator, modifies the MIDI generator output to accommodate the modulating keyboard and to induce the phenomenon that is relative transposition.

The term "unison" refers to the condition where the key signature is C major and the root tone is the unity key. The unison condition may occur when the modulating keyboard is turned on, reset, or, as a result of more than one modulation causing the key signature to return to C major and the root tone is the Unity Key.

The term "omicron" refers to a small key on the modulating keyboard to the left of the tonic of the current key signature, which indicates the position of the tonic but does not produce a sound.

The term "omega" refers to a small key on the modulating keyboard to the left of the subdominant of the current key signature, which indicates the position of the subdominant but does not produce a sound.

The term "unity key" refers to a key in the middle of the modulating keyboard which may be marked by dots (or other indications) on the instrument case which indicates a C note at the time the modulating keyboard is turned on.

The term "stretch function" refers to a function by which two values are added (beta and epsilon) to the standard 12 note octave to create a 14 note octave (C14) upon which all subsequent relative modulations are based. In some examples, the stretch function translates C14 MIDI note values into corresponding (e.g., synonymous) twelve note octave MIDI note values.

The term "beta" refers to a first of two note values added to the standard 12 note octave during the stretch function to accommodate relative transposition.

The term "epsilon" refers to a second of two note values added to the standard 12 note octave during the stretch function to accommodate relative transposition.

The term "C14" refers to the fourteen note scale (A, A#, B, Beta, C, C#, D, D#, E, Epsilon, F, F#, G, G#) that is created by the stretch function, by adding two values (beta and epsilon) to the 12 tone/note western octave and used during relative transposition.

The term "group number" refers to a number used to ensure stepwise relative transposition, by converting the starting value (SV) of each key's switch into a group number value (GNV). The conversion to GNV, for each key, may be determined as: (SV+(Group Number×2))=GNV. The determination of GNV is desirable to ensure stepwise modulation, whenever the group position extends above 11 or goes below 0 back onto itself. Without determining the group number and GNV, a modulation such as C# (group position 0) to F# (group position 11) would result in a transposition where the value of each key could move by more than 1 semitone.

The term "group position" refers to a change in the key signature played by all the white keys on the modulating keyboard. In an example embodiment, there may be twelve (12) group positions numbered (0-11). Each group position may have an associated unique formula (i.e., a mapping), that may interpret the GNV of each key's switch and convert the value by one semitone to achieve a desired target key signature. Together the group position and the group number create a near infinite number of keyboard layouts for each possible transposition. Without group position the modulating keyboard may only play in the key of C. Without the group number, there would only be twelve (12) keyboard layouts; and a modulation such as C# (Group Position 0) to F# (Group Position 11) would result in a transposition where the value of each key could move by more than 1 semitone.

Referring to FIG. 1, an overhead perspective view diagram of a portion 102 of example modulating keyboard 100 is shown. Portion 102 represents a portion of keyboard 100 (including an octave of keyboard 100) that is configured to play the 12 notes of the Western scale. In general, keyboard 102 may include one or more octaves. In some examples, keyboard 100 may include, without being limited to, seven portions 102 (i.e., seven octaves). In some examples, keyboard 100 may include, without being limited to, 70 keys (a combination of first and second keys 104, 106), about five octaves of 14 notes per octave.

Keyboard 100 may include first keys 104 and second keys 106 that alternate with first keys 104. As shown further in FIG. 3A, second keys 106 continually alternate with first keys 104 throughout each octave. This is different than a standard keyboard where two pairs of white keys are arranged next to each other in an octave. Thus, within an octave, keyboard 100 may include seven first keys 104 and seven second keys 106.

In modulating keyboard 100, first keys 104 may be assigned note values representing all notes in a current key signature (regardless of whether the notes are flatted or sharped). Second keys 106 may be assigned note values that are not part of the current key signature. In this manner, all key signatures containing flats and/or sharps may be played solely on the first keys 104, as if the key signature were C major. For example, see FIGS. 3A-3E.

Figure 3A:
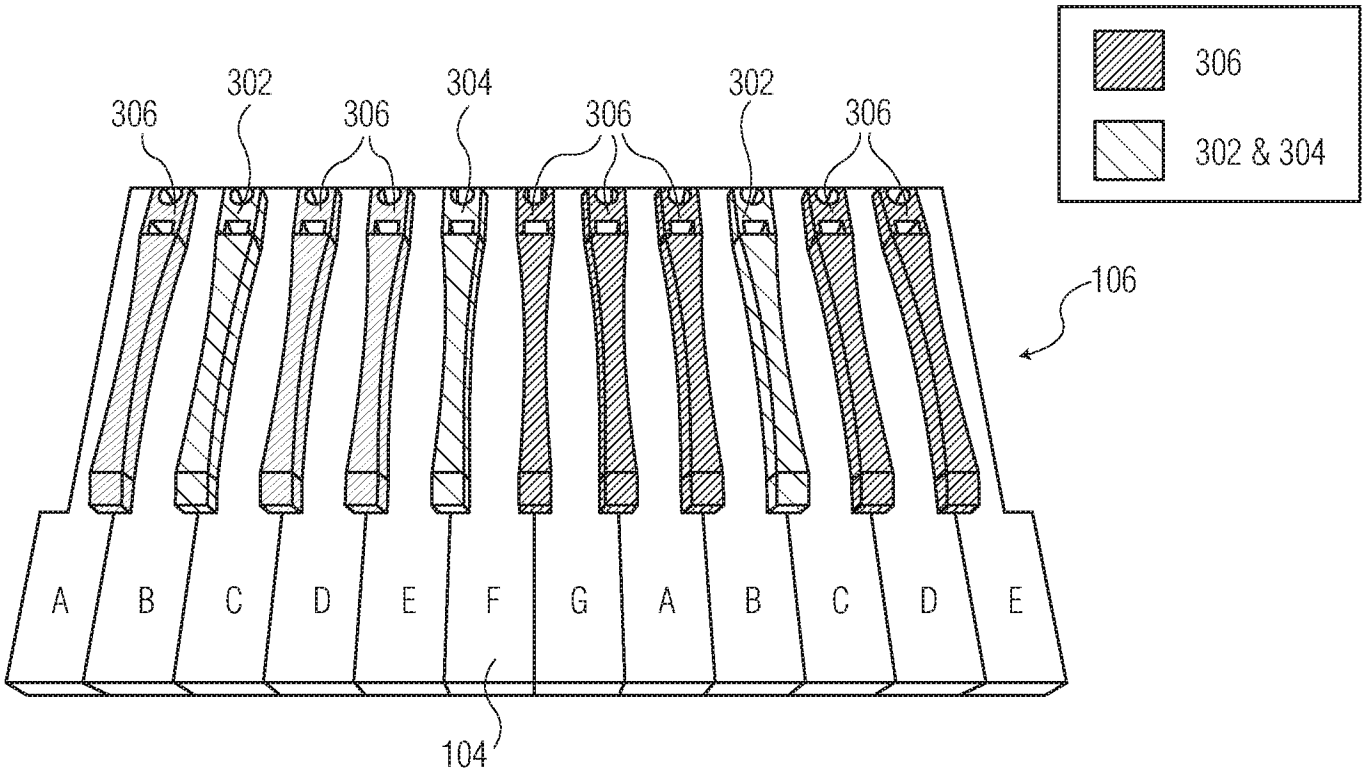
FIGS. 3A, 3B, 3C, 3D and 3E are overhead perspective view diagrams of exemplary embodiments of a modulating keyboard illustrating example note assignments before and after various relative key transpositions, according to aspects of the present disclosure.

Two of second keys 106, in each octave, may be configured to indicate note position in a scale of a current key signature to the player (e.g., omicron 302, omega 304 shown in FIG. 3A). (Omicron 302 and omega 304 are also referred to herein as respective position keys 302 and 304). These two second keys may not be assigned a note value (i.e., may be assigned a null value), such that these two keys will not sound if played. For example, the two position keys 302, 304 may remain clear (or flash, change color, etc.) to indicate the position of the tonic (based on position key 302) and the subdominant (based on position key 304). The remaining keys 306 among second keys 106 (See FIG. 3A) may be illuminated in a darker color giving the impression that these remaining keys represent playable keys typical of a standard keyboard. The description herein describes two position keys 302, 304 (omicron 302, omega 304) as being assigned a null value. The two position keys 302,304 refer to two second keys 106 in each octave of keyboard 100. In other words, in keyboard 100, there are two position keys 302, 304 associated with each octave.

In the description herein, first keys 104 are also referred to as "white" keys. It is understood that first keys 104 configured as white keys represents an example embodiment, and that first keys 104 may be configured in any suitable color and/or material. In the description herein, second keys 106 are also referred to as "clear" keys. Second keys 106 configured as clear keys represent an example embodiment for indicating note position to a user for various key signatures. It is understood that second keys 106 may be of any suitable transparency, translucency and/or material in order to indicate note position/note playability to a player. In some examples, one position key may be used to indicate a note position to the player. In some examples, position keys 302, 304 may be configured to be illuminated (or flash, etc.) while the remaining second keys 306 may be configured to remain clear (or illuminated in a constant color, etc.). In general, position keys 302, 304 may be configured to indicate a non-playability of keys 302, 304 for the current key signature as well as tonic and subdominant position, whereas remaining keys 306 among second keys 106 may indicate a playability of keys 306 for the current key signature, by any suitable mechanism.

Modulating keyboard 100 may resemble the standard keyboard normally found on pianos, organs and other electronic keyboard instruments in that keyboard 100 includes both large keys 104 (traditionally these keys are white in color) and small keys 106 (traditionally these keys are black in color). Modulating keyboard 100, however, alternates equally between first (e.g., larger) keys 104 and second (e.g., smaller) keys 106 across the entire key bed. This arrangement results in fourteen keys in each octave, as opposed to twelve for the standard keyboard (See FIG. 1). Each first key 104 may be identical in size and shape to every other first key 104. Each second key 106 may be identical in size and shape to every other second key 106 on modulating keyboard 100.

In some examples, and in contrast to a standard keyboard, all first and second keys 104, 106 on modulating keyboard 100 may be equally spaced, with second keys 106 having a non-rectangular shape. In one non-limiting example, second keys 106 may taper towards the middle (i.e., forming an hourglass shape). Accordingly, the stem of each first key 104 may widen where second keys 106 taper. First keys 104 may be white, while second keys 106 may be clear (e.g., such that position keys 302, 304 may be configured to remain clear to indicate note position). It is understood that the hourglass shape of second keys 106 shown in FIG. 1 represents an example embodiment, and that second keys 106 may be any other suitable non-rectangular or rectangular shape.

The size and shape of keys 104, 106 on modulating keyboard 100 may be designed so that the width of an octave is the same (or similar) on keyboard 100 as on a standard keyboard. Keys 104, 106 (e.g., size, shape) may also be designed so that the feel and playability of both keyboards (i.e., keyboard 100 and a standard keyboard) are similar, with several notable differences.

In keyboard 100, all major scales, or any mode thereof, may primarily be played on first keys 104. In other words, the fingering for playing a C major scale on a standard keyboard may be used to play all scales and modes, even upon modulating to a different key signature. To orient the player to their position in the current key signature, two second keys that are immediately to the left of the tonic (omicron 302), and immediately to the left of the subdominant (omega 304) scale degrees may remain clear and not produce a note value. These keys 302, 304 may remain clear because no tone exists between the leading tone and the tonic or between the median and the subdominant in the Western 12 tone octave, and no sound would be produced when either of these two keys 302, 304 is played. All of the other second keys 106 may be configured to be illuminated in a darker color, giving the player the impression that they are looking at and playing a standard keyboard.

For example, as shown in FIG. 3A, if the tonic note is C (in C major), position key 302 between B and C and position key 304 between E and F may remain clear, because no tone exists between the leading tone and the tonic or between the median and the subdominant in the Western 12 tone octave. Thus, no sound would be produced when either of those position keys 302, 304 is played. Accordingly, position keys 302, 304, in addition to indicating note position, also indicates that these notes are not playable (in comparison with the remaining second keys 106).

Figure 2:
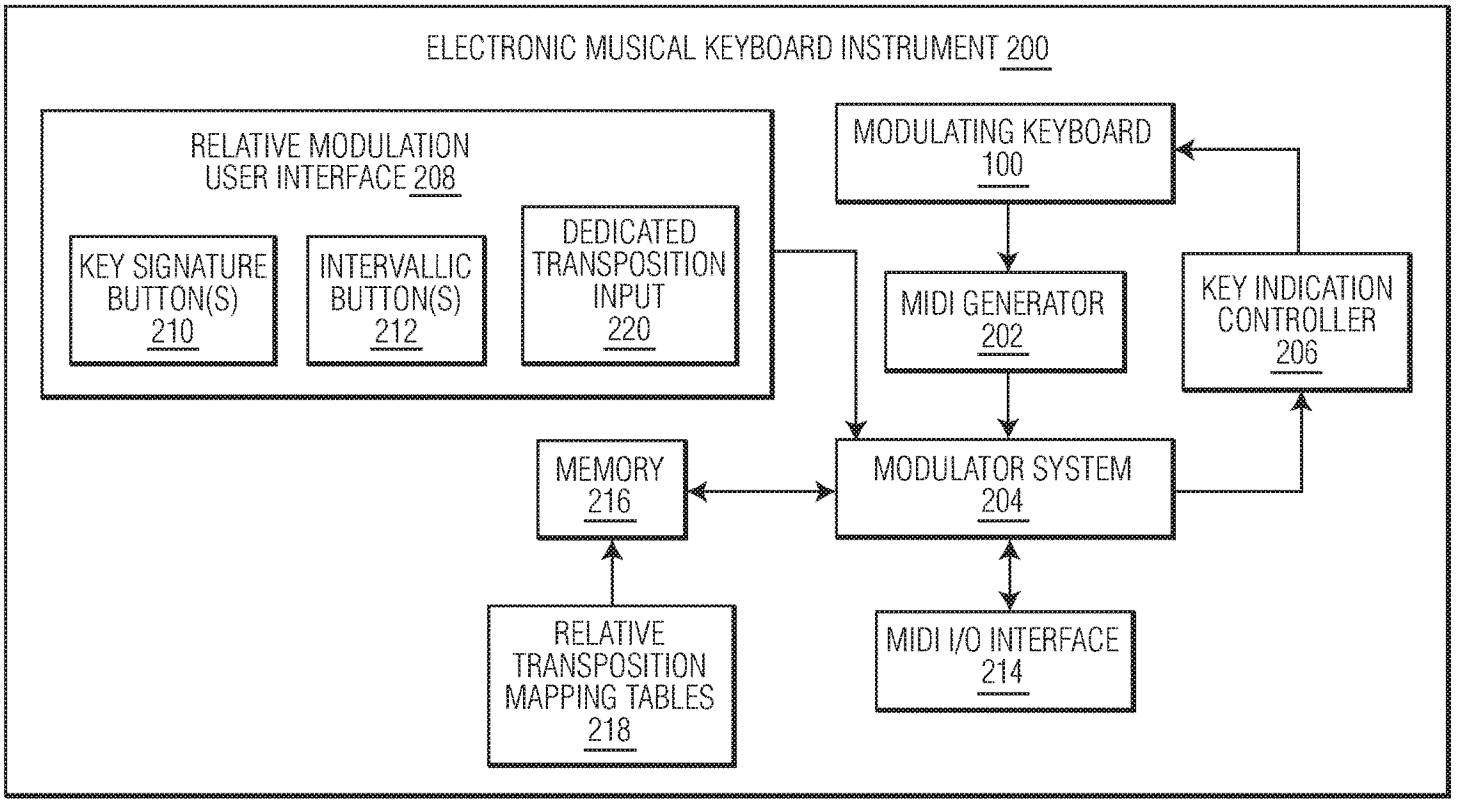
FIG. 2 is an exemplary embodiment of a functional block diagram of an example electronic keyboard musical instrument including the modulating keyboard shown in FIG. 1, according to an aspect of the present disclosure.

Referring to FIG. 2, an electronic musical keyboard instrument 200 is shown. Instrument 200 may include modulating keyboard 100 (described above in FIG. 1), MIDI generator 202, modulator system 204, key indication controller 206, relative modulation user interface 208, MIDI input/output (I/O) interface 214 and non-transitory memory 216. Instrument 200 may include other features typically found in other electronic musical keyboard instruments, such as, without being limited to, direct transposition, instrument voice selection, instrument characteristic selection, portamento, etc.

MIDI generator 202 may be electronically coupled to each of first and second keys 104, 106, and may generate a MIDI message associated with each key. For example, depressing or releasing one or more of first and second keys 104, 106 may cause MIDI generator 202 to generate a MIDI message associated with the key(s) 104, 106. (Activation of a key and release of a key are typically considered to be separate events with respect to MIDI messages). The MIDI message may be used to indicate musical performance information for a particular key. A MIDI message may include, for example, note "on," note "off," and note velocity information. A MIDI note "on" message typically includes a numerical value indicating which note should be output (i.e., sounded). In general, a MIDI message includes an eight-bit status byte that is generally followed by one or two data bytes.

Modulator system 204 may be electronically coupled to MIDI generator 202, key indication controller 206, relative modulation user interface 208, MIDI I/O interface 214 and memory 216. Modulator system 204 may receive MIDI messages from MIDI generator 202 associated with first and second keys 104, 106, and may convert the content of the received MIDI messages according to a relative transposition mapping, based on a (current or target) key signature. The key signature may be received from a player via relative modulation user interface 208, and/or via a remote MIDI device (not shown) via MIDI I/O interface 214.

Modulator system 204 may determine the mapping based on one or more predetermined relative transposition mapping tables 218 stored in memory 216. Example mapping tables 218 are described further below and shown in Table 2. Modulator system 204 may also apply a stretching function, described below, to convert note values associated with the C14 scale of keyboard 100 to a twelve note scale associated with standard keyboards and that is recognized by MIDI generator 202. Modulator system 204 generates output MIDI message(s) that represent note values for first and second keys 104, 106 based on the relative transposition. The note values for second keys 106 may include null values for position keys 302, 304. The output MIDI message(s) may be output to remote MIDI device(s) (not shown) via MIDI I/O interface 214. A remote MIDI device may, for example, translate the output MIDI message(s) to note values and output instrument sound values corresponding to the note values.

Modulator system 204 may also be configured to communicate with key indication controller 206, a current key signature and/or target key signature. Key indication controller 206 may activate/deactivate particular position/playability indicators corresponding to second keys 106, based on the key signature. The indicators (e.g., light sources such as light emitting diodes (LEDs)) may be disposed on, within or proximate to second keys 106. In some examples, second keys 106 may be configured from a semiconductor material, for example, which may cause second keys 106 themselves to be illuminated when activated.

Relative modulation selection interface 208 may include any suitable interface for receiving key signature selections from a player. Interface 208 may also include any suitable display for indicating key signature selection to the player. Interface 208 may include one or more key signature buttons 210 for directly selecting a key signature. In one example, key signature buttons 210 may include twelve buttons with a corresponding note name associated with a respective key signature. In some examples, key signature buttons 210 may include one or more buttons and a display to sequentially select among the twelve key signatures. Interface 208 may include one or more intervallic buttons 212. In one example, intervallic buttons 212 may include eleven intervallic buttons representing the eleven possible intervallic movements that can be made from any given key. In some examples, intervallic buttons 210 may include one or more buttons and a display to sequentially select among the eleven possible intervallic movements. In some examples, interface 208 may include a dedicated transposition input (DTI) interface 220 for directly selecting a key signature. DTI interface 220 may be configured to operate similarly to key signature button(s) 210, except that DTI interface 220 may be configured to receive a key signature selection via MIDI message(s) received from an external MIDI driver. For example, when a MIDI driver sends a MIDI message containing the note C to DTI interface 220 (via MIDI I/O interface 214), modulator system 204 may determine, from the received message, that a key signature selection of C is requested. Key signature button(s) 210 and intervallic button(s) may represent any suitable selection mechanism, including push buttons, a touch pad, toggle switches, an interactive display, etc.

MIDI I/O interface 214 may be coupled to modulator system 204 and may include one or more MIDI input ports, one or more MIDI output ports or combination thereof, suitable for receiving or transmitting MIDI information, including MIDI messages. MIDI I/O interface 214 may also include a transposition MIDI input port (e.g., DTI interface 220) for remotely inducing a relative transposition to instrument 200.

Memory 216 may include, for example, without being limited to, at least one of a read-only memory (ROM), a random access memory (RAM), a flash memory, a dynamic RAM (DRAM) and a static RAM (SRAM), storing computer-readable instructions executable by one or more components of instrument 200 (such as modulator system 204). In general, memory 216 may include any suitable non-transitory computer readable storage medium storing computer-readable instructions executable by components of instrument 200 (including modulator system 204) for performing the operations described herein. Although not shown, instrument 200 may include a processing device which may include, without being limited to, a microcontroller, a microprocessor, a central processing unit, an application specific integrated circuit (ASIC), a field programmable gate array (FPGA) and/or a digital signal processor (DSP). The processing device may be configured to execute processing logic for performing the operations described herein.

Figure 10:
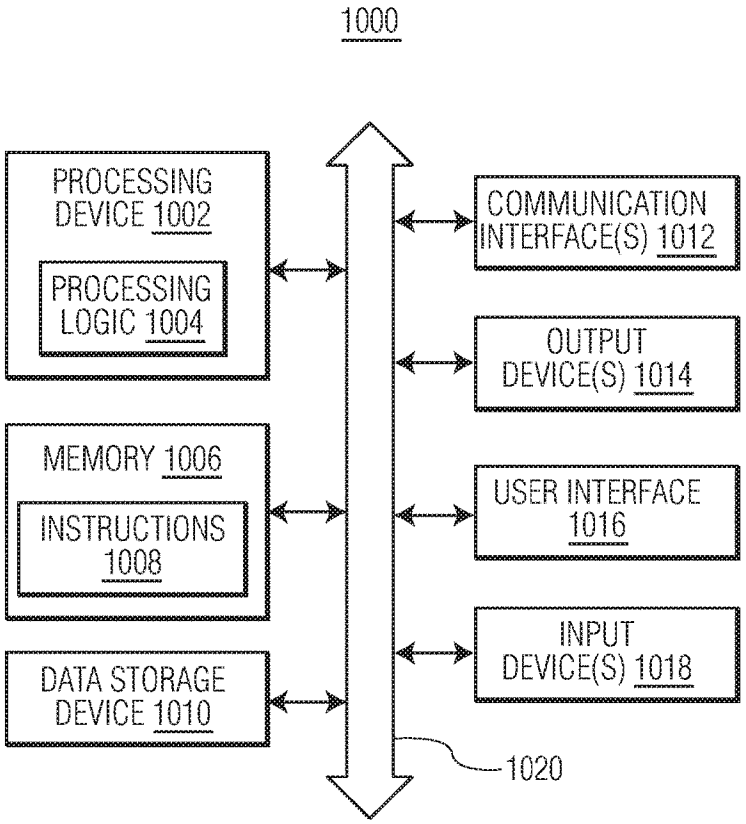
FIG. 10 is an exemplary embodiment of a functional block diagram of an example computer system, according to an aspect of the present disclosure.

Some portions of the above description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcontrollers, microcode, or the like. It is understood that MIDI generator 202, modulator system 204, key indication controller 206, relative modulation user interface 208, MIDI I/O interface 214 and non-transitory memory 216 may include any specially-configured hardware, specialized software, firmware or any combination thereof for performing the functions described herein. In some examples, MIDI generator 202, modulator system 204, key controller 206, MIDI I/O interface 214 and memory 216 storing relative transposition mapping tables 218 may be implemented by a specially configured microcontroller (such as shown in FIG. 10). In some examples, components 202-220 may be configured for plug and play operation.

FIGS. 3A-3E illustrate example note assignments before and after various relative key transpositions, according to aspects of the present disclosure. For example, FIG. 3A illustrates a C major key signature, with omicron key 302 indicating tonic note C and omega key 304 indicating subdominant note F. Keys 302 and 304 are indicated differently from remaining second keys 306, to indicate to the player the position of the tonic and subdominant notes as well as the non-playability of keys 302, 304.

Figure 3B:
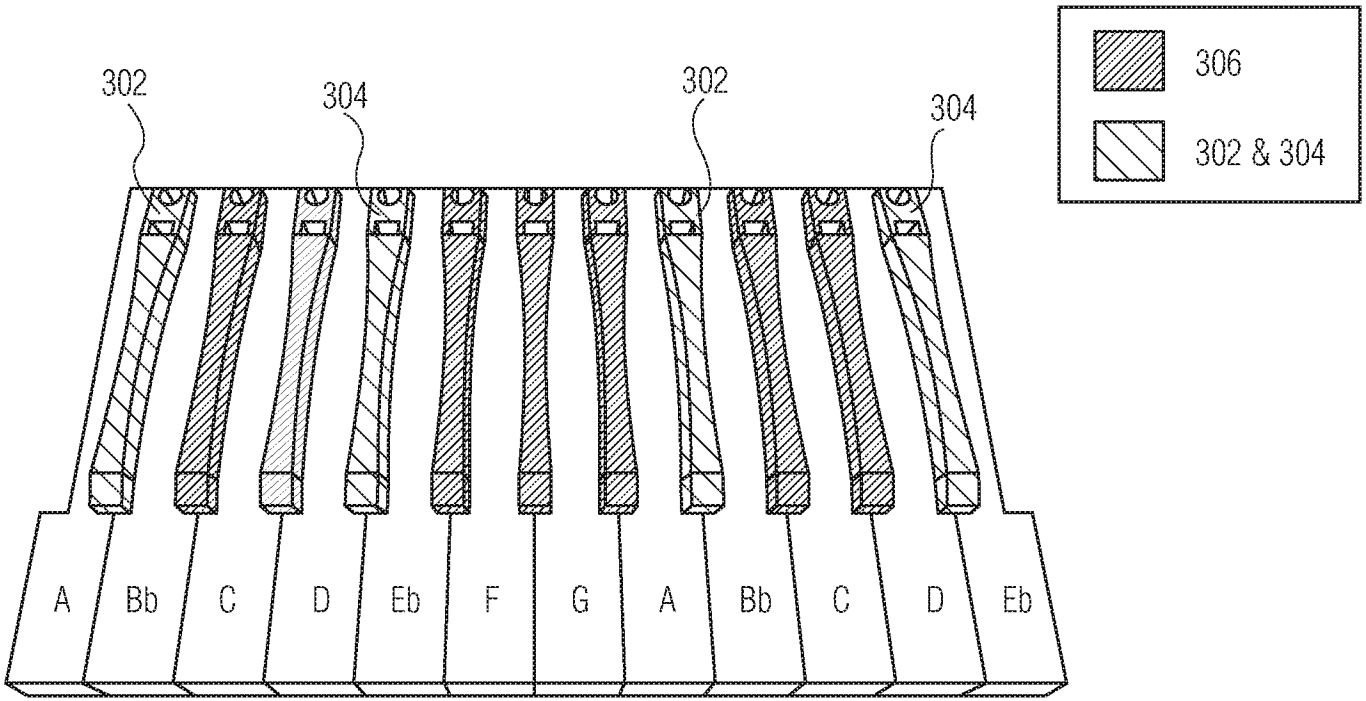
Figure 3C:
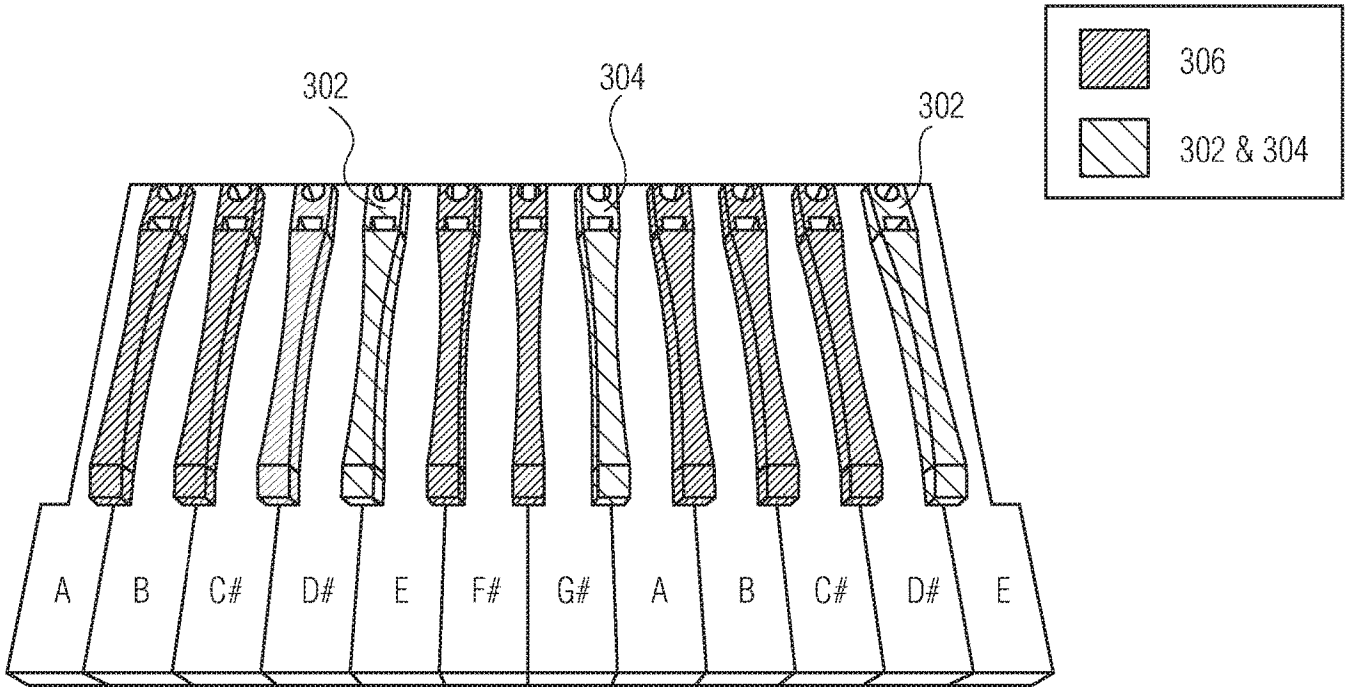
Figure 3D:
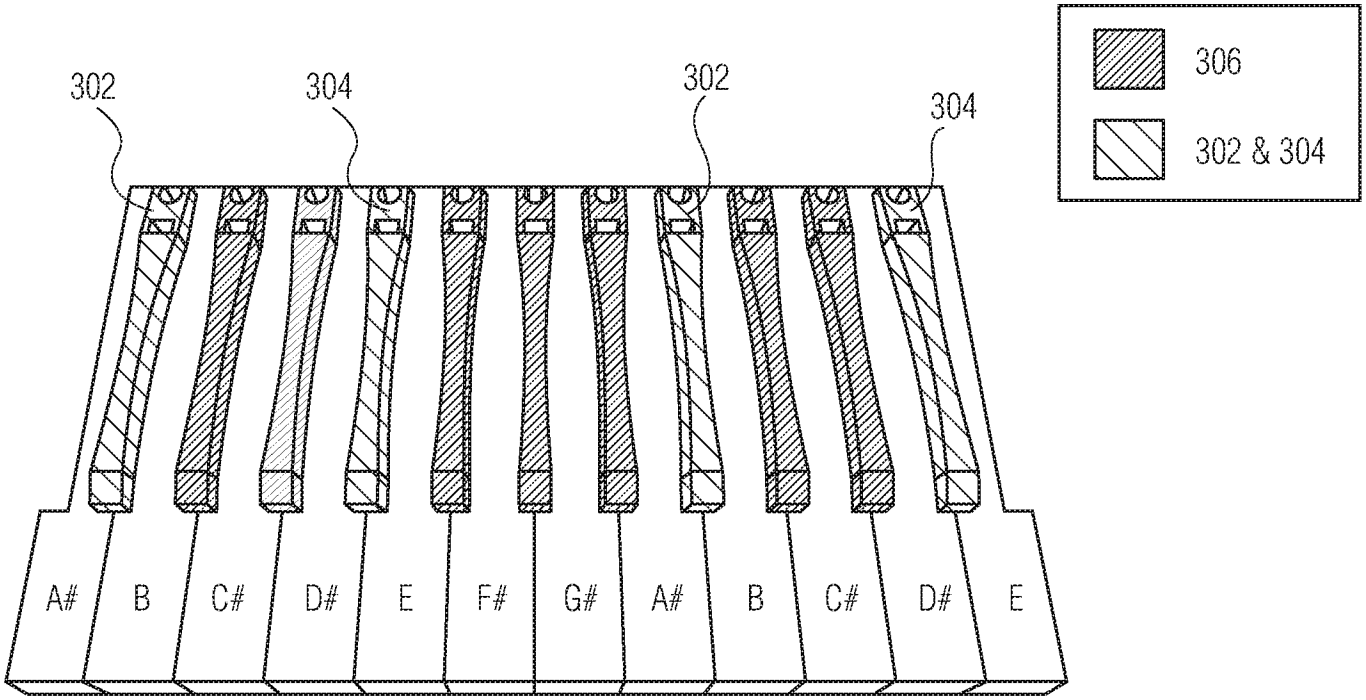
Figure 3E:
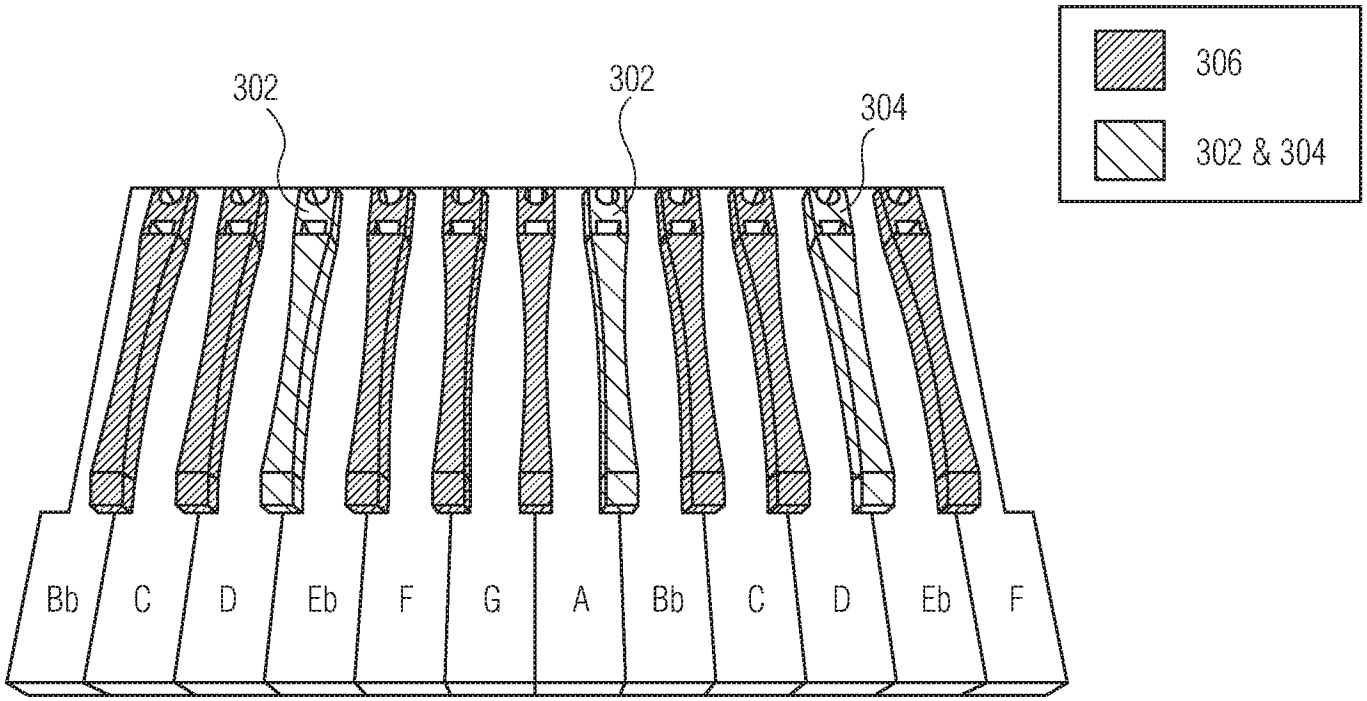

FIG. 3B illustrates the assignment of notes in the target key signature of B flat (a major 2nd down from the current key signature of C major (FIG. 3A)). FIG. 3B also illustrates position keys 302, 304 relative to tonic note B flat and subdominant note E flat. As can be seen in FIG. 3B, all notes in the key signature are assigned to first keys 104. FIG. 3C illustrates the assignment of notes in the target key signature of E major (a major 3rd up from the current key signature of C major (FIG. 3A)). FIG. 3C also illustrates position keys 302, 304 relative to tonic note E and subdominant note A. As can be seen in FIG. 3C, all notes in the key signature are assigned to first keys 104. FIG. 3D illustrates the assignment of notes in the target key signature of B major (a minor 2nd down from the current key signature of C major (FIG. 3A)). FIG. 3D also illustrates position keys 302, 304 relative to tonic note B and subdominant note D. FIG. 3E illustrates the assignment of notes in the target key signature of B flat major (a minor 2nd down from the current key signature of B major (FIG. 3D)). FIG. 3E also illustrates position keys 302, 304 relative to tonic note B flat and subdominant note E flat.

Figure 4A:
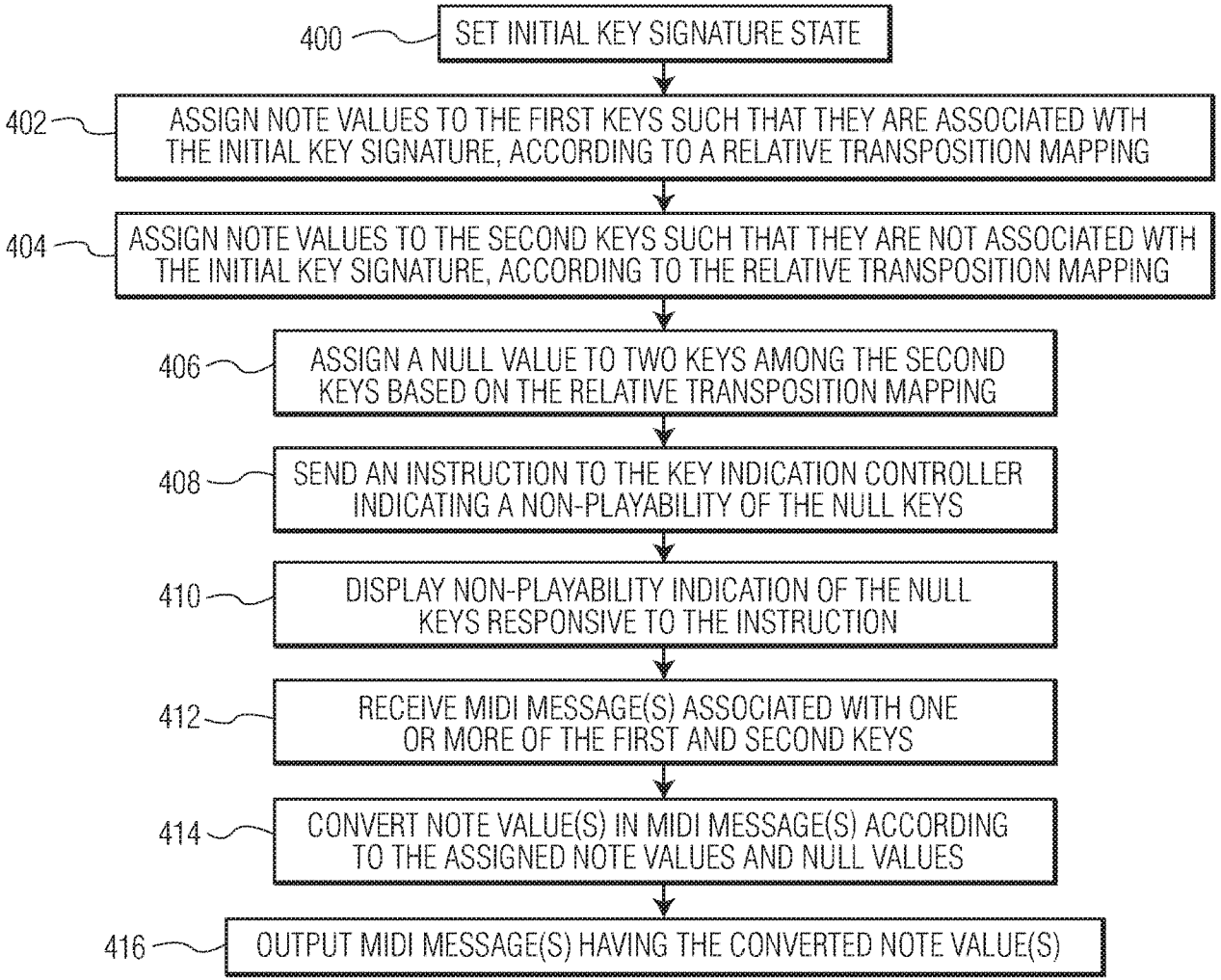
FIG. 4A is an exemplary embodiment of a flowchart of an example method of assigning note values for a modulating keyboard for an initial key signature state, according to an aspect of the present disclosure.
Figure 4B:
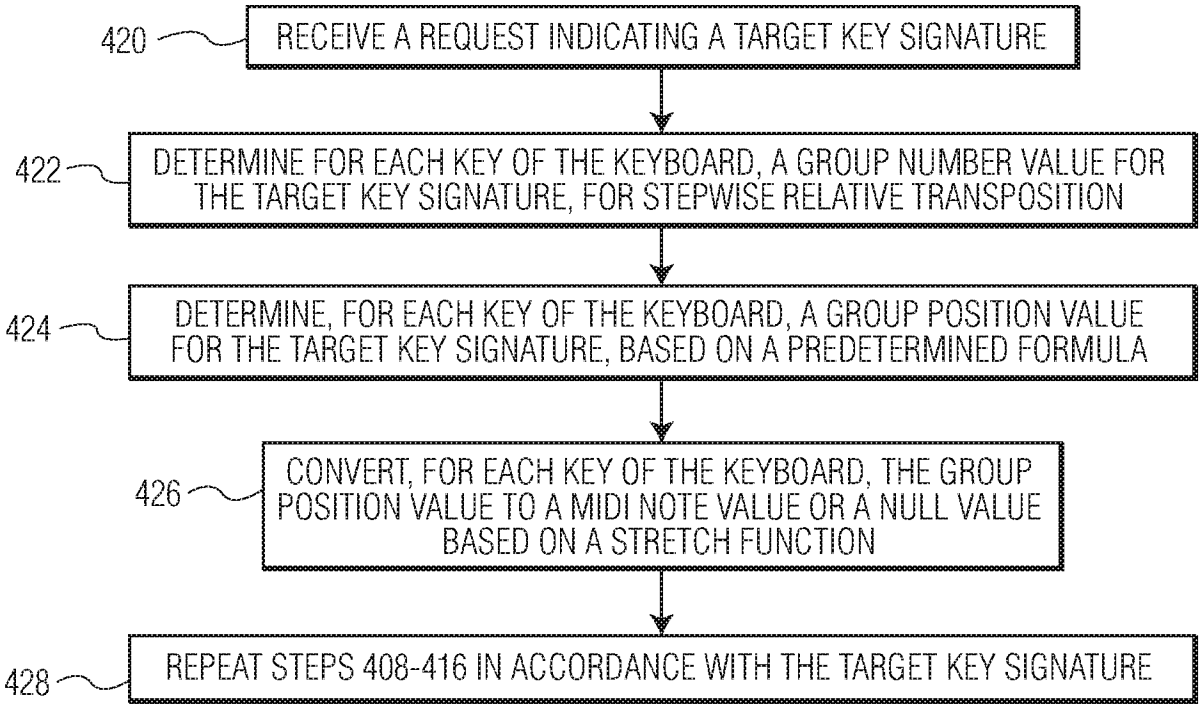
FIG. 4B is an exemplary embodiment of a flowchart of an example method of performing relative transposition for a modulating keyboard from a current key signature to a target key signature, according to an aspect of the present disclosure.

Referring next to FIGS. 4A and 4B, example methods of initializing instrument 200 and performing relative transposition are shown. In particular, FIG. 4A is a flowchart of an example method of assigning note values for modulating keyboard 100 for an initial key signature state; and FIG. 4B is a flowchart of an example method of performing relative transposition for modulating keyboard 100 from a current key signature to a target key signature. FIGS. 4A and 4B are described with respect to FIGS. 1, 2 and 3A.

Those skilled in the art will appreciate that electronic musical keyboard instrument 200 may be configured with more or less components to conduct the methods described herein with reference to FIGS. 4A and 4B. As illustrated in FIGS. 4A and 4B, the methods shown may be performed by processing logic that may comprise hardware (e.g., circuitry, dedicated logic, programmable logic, a microcontroller, microcode, etc.), software (such as instructions run on a processing device), or a combination thereof. In one embodiment, the methods shown in FIGS. 4A and 4B may be performed by one or more specialized components associated with components 202-220 of instrument 200 of FIG. 2.

Referring to FIG. 4A, at step 400, an initial key signature state may be set, for example, by modulator system 204. At step 402, note values may be assigned to first keys 104, such that first keys 104 are associated with the initial key signature, according to a relative transposition mapping. At step 404, note values may be assigned to second keys 306, such that second keys 306 are not associated with the initial key signature, according to the relative transposition mapping. At step 406, a null value may be assigned to each of two position keys 302 and 304 (among second keys 106, in each octave), based on the relative transposition mapping. Thus, among second keys 106, position keys 302, 304 are assigned a null value and remaining keys 306 are assigned playable notes that are not in the initial key signature.

In general, modulator system 204 may assign, for each octave, note values to first keys 104, note values to second keys 306 and null values to position keys 302, 304 according to one or more relative transposition mapping tables 218 (also referred to herein as C14 tables). In an example embodiment, the initial key signature state may be C major. In some examples, the initial key signature state may be set when instrument 200 is turned on and/or reset.

In an example embodiment, MIDI generator 202 may assign every switch in keyboard 100 a value from a C14 table 218. For example, a leftmost switch may be assigned a C14 value that corresponds to a note in C major (e.g., a C value such as 14 or 28) and every subsequent switch may be assigned a C14 value that is one greater than the note value assignment of the previous switch. The C14 value held by each switch at this point may be referred to as its starting value (SV). In some examples, the initial key signature state may be assigned a group number of 0 and a group position of 5, associated with C Major (discussed further below with respect to FIG. 4B). The group number may be used to ensure stepwise relative transposition (i.e., such that the value of each key is not moved by more than one semitone).

At step 408, an instruction may be sent from modulator system 204 to key indication controller 206 indicating a non-playability of the two null keys (i.e., position keys 302, 306). At step 410, key indication controller 206 may cause position keys 304, 306 to display a non-playability indication, responsive to the instruction. For example, as discussed above, position keys 302, 304, may remain clear (or illuminated) while remaining keys 306 are illuminated a darker color (or remain clear). In general, key indication controller 206 may control light sources associated with each of second keys 106 to indicate a non-playability of position keys 302, 304 and a playability of remaining second keys 306.

At step 412, modulator system 204 may receive one or more MIDI messages from MIDI generator 202 corresponding to one or more keys 104, 106. At step 414, modulator system 204 may convert note value(s) in the received MIDI message(s) to corresponding assigned note values and/or null values based on the first keys 104 and/or second keys 106 indicated in the MIDI message(s). At step 416, MIDI system 204 may output one or more MIDI messages, for example, via MIDI I/O interface 214, with the converted note value(s). Steps 412-416 may be repeated. In this manner, MIDI messages of modulating keyboard 100 having a C14 octave configuration may be converted to a MIDI messages associated with twelve note octave note values.

A player of modulating keyboard 100 may at any time change the key signature being played, via interface 208, to any of the eleven other key signatures not currently in use (twenty two if relative minor key signatures are included (without including the relative minor of the current key)). The relative transposition of modulator system 204 may function by only changing the notes that are not shared by the current key signature and the target key signature. Modulator system 204 may causes position keys 302, 304 before the tonic and the 4th scale degree of the key to, for example, remain clear, thereby orienting the player to where they are in the current scale. For example, using relative transposition to change key from C to Eb would change first keys 104 that played E, A and B to play Eb, Ab and Bb, respectively. Modulator system 204 would also cause second keys behind each of the Eb and Ab assigned keys 104 to remain clear, thereby showing the position of the new tonic.

Referring next to FIG. 4B, an example method of performing relative transposition from a current key signature to a target key signature is shown. At step 420, modulator system 204 may receive a request from interface 208 indicating a target key signature for relative transposition. At step 422, modulator system 204 may determine, for each key 104, 106 of keyboard 100, a group number value (GNV) for the target key signature, for stepwise relative transposition.

To determine the group number value, the current group number is multiplied by 2 and added to the SV held by each key switch. The value held by each switch at this point is the group number value, where SV+(Group Number×2))=GNV. For example, when the SV of a switch is 64 and the group number is −1, −1 is multiplied by 2. The resulting −2 is then added to 64, such that the GNV is 62.

Figure 9:
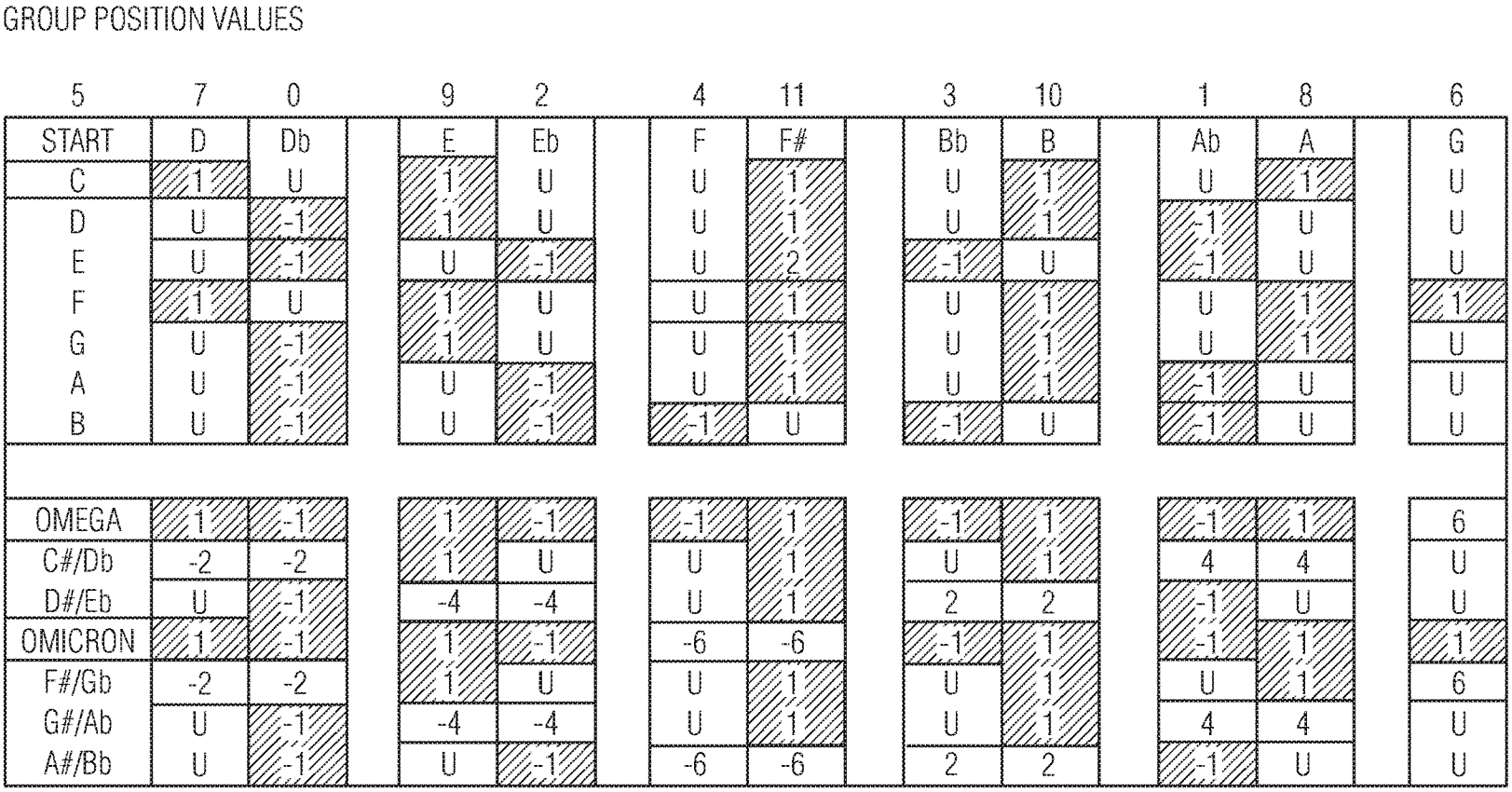
FIG. 9 is an exemplary embodiment of an example chart of pseudocode for relative key transposition, according to an aspect of the present disclosure.

At step 424, modulator system 204 may determine, for each key 104, 106 of keyboard 100, a group position value for the target key signature, based on a predetermined formula that interprets the GNV for each switch and changes the value by one semitone to achieve the target key signature. Examples of group position value formulas are shown in FIG. 9. In particular, FIG. 9 is an example chart of pseudocode for relative key transposition. In FIG. 9, group position values are illustrated as a function of key signature (first row of the top group row), notes of first keys 104 (on the top group row; i.e., notes C, D, E, F, G, A, B) and notes of second playable keys 306 (i.e., notes C#/Db, D#/Eb, F#/Gb, G#/Ab, A#/Bb), and the non-playable omicron and omega keys 302, 304 (on the bottom group row). In FIG. 9, "U" represents no change in value. The numbers (e.g., 0, 1, −1, 2, 4, etc.) represent a value applied to the group number value to determine the group position value. Start represents the initial key signature (C Major) when instrument 100 is turned on and/or reset.

The group number value of each switch (to obtain the target key signature) may be changed based on the group position value. As discussed above, twelve group positions may be assigned (one for each key signature). Each of the twelve group positions may be associated with a unique predefined formula. The predefined formulas (i.e., mappings) may identify the group position value used to modify the group number value, so that each switch that utilizes a first key 104 contains a note value that is in the key signature associated with the target group position. In some examples, steps 422 and 424 may be combined into one step that uses predetermined formulas (i.e., relative transposition mapping tables 218) that performs relative transposition while at the same time maintaining stepwise relative transposition, described further below.

At step 426, modulator system 204 may convert, for each key 104, 106 of keyboard 100, the group position value (determined in step 424) to an output MIDI note value or a null value, based on a stretch function. The output MIDI note value is provided in the MIDI message sent to an external device from MIDI I/O interface 215, and represents the MIDI value for the note in the MIDI message that is output when a corresponding switch of keyboard 100 is depressed.

Modulator system 204, via the stretch function, may determine whether second keys 106, for each octave, output a note value or a null value by comparing the group position value to at least one predetermined threshold (or predetermined limits). When modulator system 204 determines that the group position value exceeds the predetermined threshold(s) (limits), the stretch function may identify these keys as omicron 304 and omega 304, and a null value (or no value) may be assigned to keys 302, 304. Key indication controller 206 may also receive an instruction to indicate a non-playability for keys 302, 306. In this manner, keys 302, 204 may signal to the player that the keys 302, 304 have not been assigned note values, and keys 302, 304 may not produce a MIDI message having a note value when depressed.

At step 428, modulator system 204 may repeat steps 408-416 (FIG. 4A) in accordance with the target key signature.

In some examples, the group number value and group position value (steps 422 and 424) may be determined dependent upon whether key signature button(s) 210 or intervallic button(s) 214 are utilized.

For example, intervallic button(s) 212 may each have an associated value:

up 5th=+1
Up Major 2nd=+2
Down Minor 3rd=+3
Up Major 3rd=+4
Down Minor Second=+5
Up Tritone=+6
Down 5th=−1
Down Major 2nd=−2
Up Minor 3rd=−3
Down Major 3rd=−4
Up Minor Second=−5
Down Tritone=−6

When a selection is received via intervallic button 212, the corresponding associated value may be added to the current group position, and relative transposition may be performed based on the modified group position (i.e., modified group position=current group position+intervallic button associated value).

The group number may change when the group position goes above 11 or below 0. This is because there are only 12 Group Positions (0-11) and they operate similar to a wheel (e.g., a circle of key signatures). Thus, when the group position goes above eleven, the group number goes up by a value of 1. When the group position goes below 0, the group number goes down by a value 1. For example, when the current group position is 10 and the "Down a Minor 3rd" (+3) button is selected, the target group position becomes 2 and the group number goes up by 1. Likewise, when the group position is 1 nd the "Down a Major 3rd" button (−4) is selected, the target group position becomes 9 and the group number goes down by 1.

Similarly, each key signature button(s) 210 may have corresponding assigned values. In one example, the assigned values for key signature button(s) 210 may include:

C#=0
G#=1
D#=2
A#=3
F=4
C=5
G=6
D=7
A=8
E=9
B=10
F#=11

In an example, the group number may be modified first. For example, when the value of the current group position (GP) minus the assigned value of the selected key signature button (KSB) is greater than 6 (i.e., GP−KSB>6), the group number goes up by a value of 1 (i.e., the target group number=current group number+1). When the value of the current group position minus the assigned value of the selected key signature button is less than −6 (i.e., GP−KSB<−6), the group number goes down 1 (i.e., the target group number=current group number−1). When the value of the current group position minus the value of the assigned value of the selected key signature button is equal to 6 or −6, or is between 6 and −6, the group number does not change.

Then, the assigned value of the selected key signature button 212 replaces the current value of the group position (to become the value of the target group position).

Selections received from DTI interface 220 may cause modulator system 204 to operate similarly as for requests via key signature button 210.

Relative transposition may be achieved, by modulator system 204, by assigning each possible modulation a unique formula that is applied to the current key signature. Each formula may be used in order to relatively transpose it to a requested target key signature. These formulas ensure that the notes that are changed during each relative transposition may only change by one semitone either up or down. The formulas may be stored as part of relative transposition mapping tables 218.

As discussed above, modulating keyboard 100 may include fourteen keys within an octave, where two of second keys 106, the one immediately before the tonic, omicron 302, and the one immediately before the subdominant, omega 304, may not be illuminated and do not produce a tone. In order to accommodate MIDI generator 202 having twelve switches in an octave, modulator system 204 may apply a stretching conversion formula to the value of MIDI notes coming from MIDI generator 202.

The stretch conversion formula may be as follows: The value of the MIDI message received is divided by 14. The value returned by this equation is rounded down and then defined as X. If the remainder of this equation is zero ("0") or ≥4, then X is multiplied by −2. If the remainder equals 5, then X is undefined. If the remainder is ≥6 or ≤12, then X is multiplied by −2 and 1 is subtracted from that value. If the remainder of the equation equals 13, then X is undefined (i.e., a null value). The result is then added by modulator system 204 to the MIDI value received in the MIDI message from MIDI generator 202 the relative transposition proceeds, as described below.

For example, if the MIDI value received by modulator system 204 is 54, modulator system 204 may divide 54 by 14, returning the result 3.8571428. The resulting value may be rounded down to 3. Modulator system 204 determines the remainder of 54 divided by 14 and returns 12. Because 12 is ≤12, the number 3 is multiplied by −2 and subtracted by 1, for a value of −7. Modulator system 204 adds the −7 value to 54, thus changing the MIDI message from 54 to 47.

In another example embodiment, modulator system 204 may translate C14 values obtained from a predetermined C14 table 218 stored in memory 216, such as the C14 Table shown in FIG. 7, into MIDI values, by applying an example stretch function according to Table 1. As shown in FIG. 7, the C14 table includes MIDI note values for a 14 note scale (C, C#, D, D#, E, epsilon, F, F#, G, G#, A, A#, B, beta) for each of 11 octaves. The stretch function may obtain a value (e.g., for a particular note in a particular octave) from the C14 table 218, and translate the value into its corresponding (synonymous) 12 note octave MIDI value.

The C14 value may be compared to X and Y limits, such as the limits shown in Table 1. When the C14 value is equal to limits X or Y, or falls between these limits, the corresponding Z value may be added to the C14 value, to produce the corresponding 12 note octave MIDI value. When the C-14 value is equal to any of the values corresponding to omicron or omega, the stretch function may return a null value and the corresponding key will not produce a note value. An example 12 note scale MIDI note value table is shown in FIG. 8. As shown in FIG. 8, the table includes MIDI note values for a 12 note scale (C, C#, D, D#, E, F, F#, G, G#, A, A#, B) for each of 11 octaves.

TABLE 1

Comparison of C14 value to Limits for Determining Null Value

| X | Y | Z |
|---|---|---|
| Between 0 | and 4 | = −0 |
| Between 6 | and 12 | = −1 |
| Between 14 | and 18 | = −2 |
| Between 20 | and 26 | = −3 |
| Between 28 | and 32 | = −4 |
| Between 34 | and 40 | = −5 |
| Between 42 | and 46 | = −6 |
| Between 48 | and 54 | = −7 |
| Between 56 | and 60 | = −8 |
| Between 62 | and 68 | = −9 |
| Between 70 | and 74 | = −10 |
| Between 76 | and 82 | = −11 |
| Between 84 | and 88 | = −12 |
| Between 90 | and 96 | = −13 |
| Between 98 | and 102 | = −14 |
| Between 104 | and 110 | = −15 |
| Between 112 | and 116 | = −16 |
| Between 118 | and 124 | = −17 |
| Between 126 | and 130 | = −18 |
| Between 132 | and 138 | = −19 |
| Between 140 | and 144 | = −20 |
| 146 | and up | = −21 |

In this example, Values: 5, 19, 33, 47, 61, 75, 89, 103, 117, 131 and 145 may return a null value for omicron. Values: 13, 27, 41, 55, 69, 83, 97, 111, 125 and 139 may return a null value for omega.

Modulator system 204 may determine the relative modulation based on mapping tables 218 stored in memory 216. Modulator system 204 may assign each of all possible key signatures to a respective signature number. The signature number may correspond to the key signature's position on the circle of fifths (e.g., relative to C major). The C major key signature may be assigned signature number 0. Key signatures to the right of C major may be assigned incrementally increasing positive signature numbers. Key signatures to the left of C major may be assigned incrementally decreasing negative signature numbers.

For example, to the right: G=1, D=2, A=3, E=4, B=5, F#1=6, C#=7, Ab=8 . . . etc.

To the left: F=−1, Bb=−2, Eb=−3, Ab=−4, Db=−5, F#2=−6, B=−7, E=−8 . . . etc.

In another example embodiment, all 12 possible key signatures may be assigned a group position. Values associated with each group position may be: C#=0, G#=1, D#=2, A#=3, F=4, C=5, G=6, D=7, A=8, E=9, B=10 and F#=11.

In one example, instrument 200 may start in the key of C major when it is first turned on or reset (which is assigned the signature number 0 (or group position 5). Every signature number (or group position) may be mapped (i.e., associated with) a unique formula that, when active, will change the value of the MIDI notes to relatively transpose the keyboard to the target key signature.

Relative transposition may be accomplished with instrument in several different ways. The first two may occur by player input via relative modulation user interface 208. A third method of relative transposition may occur via an input MIDI signal via MIDI I/O interface 214.

For example, a first way to request relative transposition on instrument 200 may include selection via one of key signature buttons 210 (e.g., selection of one of twelve buttons having a key signature note name located on instrument 200, such as behind keyboard 100). Selection of key signature button(s) 210 may transpose keyboard 100 to the indicated key signature.

A second example way to request relative transposition may include selection via one of intervallic button(s) (e.g., selection of one of eleven intervallic buttons representing one out of the eleven possible intervallic movements from any given key located on instrument 200, such as behind keyboard 100). Selection of intervallic button(s) 212 may cause modulator system 204 to relatively transpose keyboard 100 from the current key by the selected interval. Because the transposition is relative, modulating down a major 2nd is the same as modulating up a minor 7th, so these two intervals will share the same button 212, and so on. An example list of formulas for each intervallic relative transposition is shown in Table 2.

TABLE 2

Example formulas for Intervallic Relative Transposition

| Interval | MIDI Message Modification |
|---|---|
| Unison = 0 | Undefined if epsilon and/or beta is played. |
| Major Second Down = −2 | Subtract by 1 if E, epsilon, B, beta is played. Undefined if Eb, Bb is played. |
| Major Second Up = +2 | Increase by 1 if C, epsilon, F, beta is played. Undefined if Db, Gb is played. |
| Minor Second Up = −5 | Subtract by 1 if D, Eb, E, epsilon, G, Ab, A, Bb, B, beta is played. Undefined if Db, Gb is played. |
| Major Third Down = −4 | Subtract by 1 if D, Eb, E, epsilon, A, Bb, B, beta is played. Undefined if Db, Ab is played. |
| Major Third Up = +4 | Increase by 1 if C, Db, D, epsilon, F, Gb, G, beta is played. Undefined if Eb, Ab is played. |
| Minor Second Down = +5 | Increase by 1 if C, Db, D, epsilon, F, Gb, G, Ab, A, beta is played. Undefined if Eb, Bb is played. |
| Fifth = +1 | Increase by 1 if epsilon, F is played. Undefined if Gb, beta is played. |
| Fourth = −1 | Subtract by 1 if B, beta is played. Undefined if epsilon, Bb is played. |
| Minor Third Down = +3 | Increase by 1 if C, epsilon, F, Gb, G, beta is played. Undefined if Db, Ab is played. |
| Minor Third Up = −3 | Subtract by 1 if E, epsilon, A, Bb, B, beta is played. Undefined if Eb, Ab is played. |
| Tritone One = +6 | Increase by 1 if C, Db, D, Eb, E, F, Gb, G, Ab, A, beta is played. Undefined if epsilon, Bb is played. |
| Tritone Two = = 6 | Subtract by 2 if C is played. Subtract by 1 if Db, D, Eb, E, epsilon, G, Ab, A, Bb, B is played. Undefined if Gb, beta is played. |

In keyboard 100, the position of the tonic note (assigned to a first key 104 within an octave) may remain the same or may change as the key signature changes. For example, large intervallic movement between current and target key signatures may cause the tonic of the target key signature to be assigned to a different first key 104 in portion 102.

In general, the relative modulation function may be configured to cause as little change/movement as possible in keyboard 100 layout (e.g., no key may change more than one semi-tone during any modulation). Otherwise, variation in keyboard layout would defeat the intended purpose of relative modulation to be more fluid than direct modulation (where keys can change by several whole tones during any one modulation). In some examples, however, small shifts of keyboard layout may occur during some modulations.

For example, when the cumulative signature number (described above) exceeds 6 or decreases below −6, the layout of keyboard 100 may shift by one first key 104 either higher (due to a negative change) or lower (due to a positive change). In general, this variation may occur when the cumulative signature number passes a multiple of 6 or −6, and it can continue to occur if the modulation continues in the same direction around the circle of fifths.

FIGS. 5A-5D represent an example of a layout of keyboard 100 that may not change during or after cumulative key signature modulations. FIGS. 6A-6D represent an example of a layout of keyboard 100 that may change during or after cumulative key signature modulations. In FIGS. 5A-5D and 6A-6D, unity key 504 (604) is illustrated for orientation purposes. Unity key 504, 604 may represent a marking which reinforces where the tonic 502 (602) is in the key of C Major when instrument 200 is turned on.

Figure 5A:
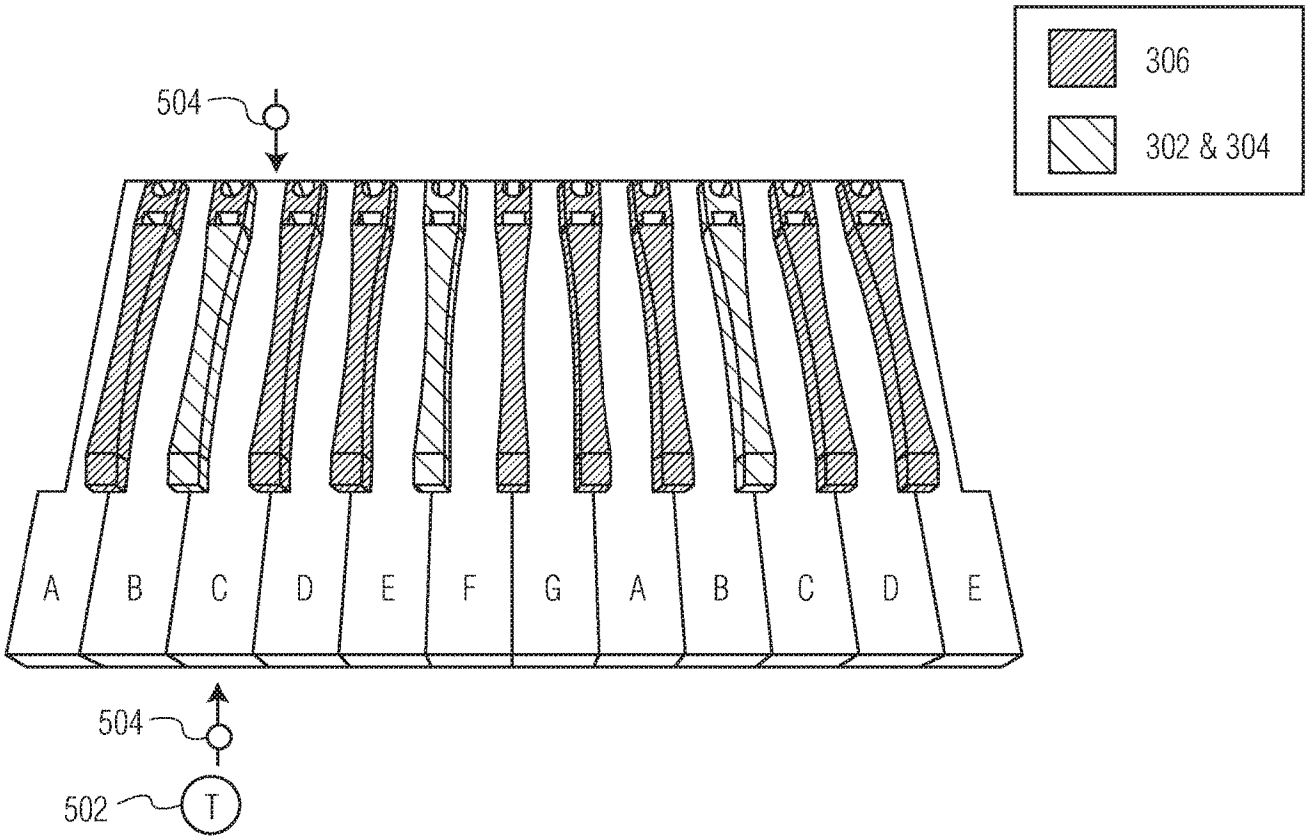
FIGS. 5A, 5B, 5C and 5D are example overhead perspective view diagrams of exemplary embodiments of a modulating keyboard illustrating example note assignments before and after various relative key transpositions, where the unity key and tonic key correspond to each other after modulation, according to aspects of the present disclosure.
Figure 5B:
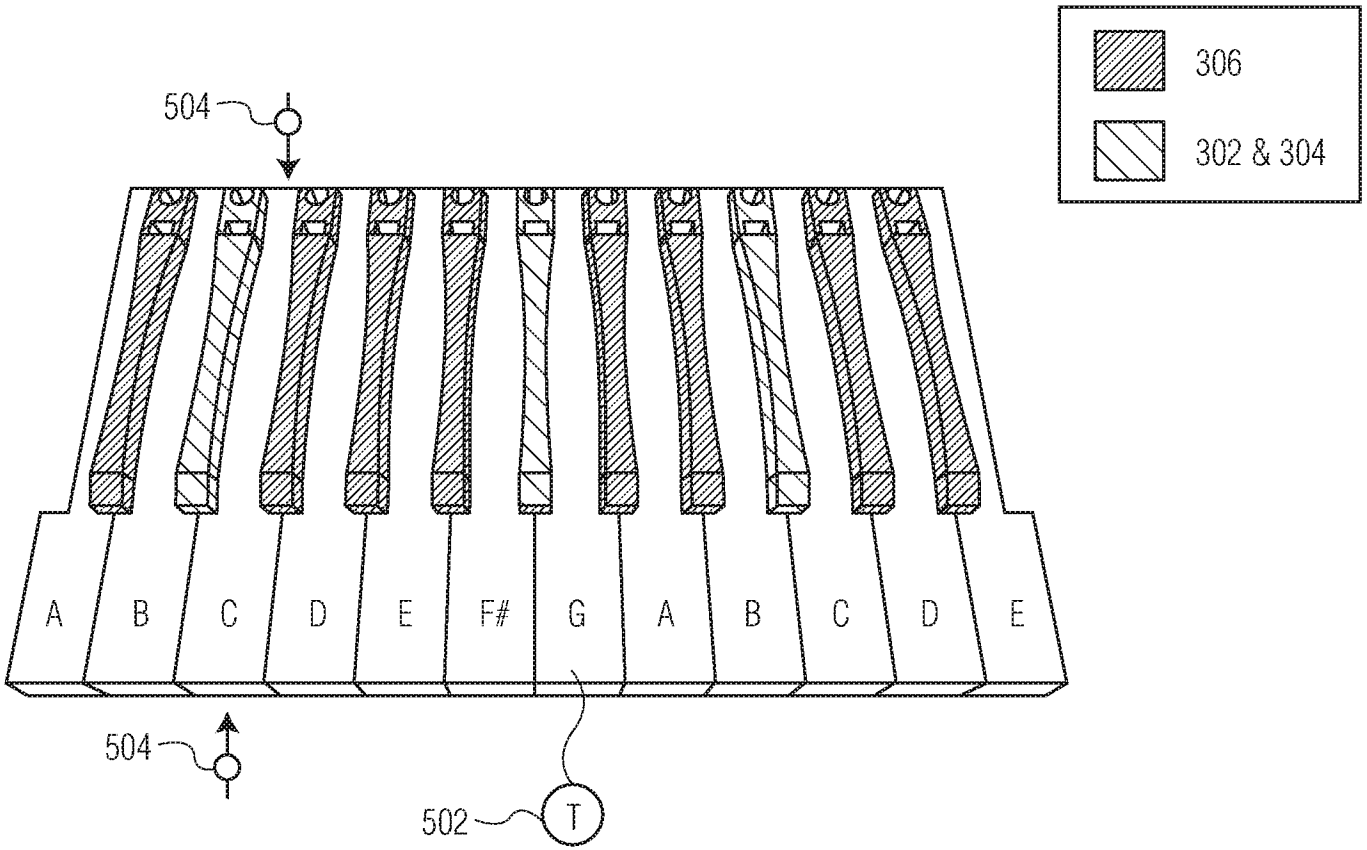
Figure 5C:
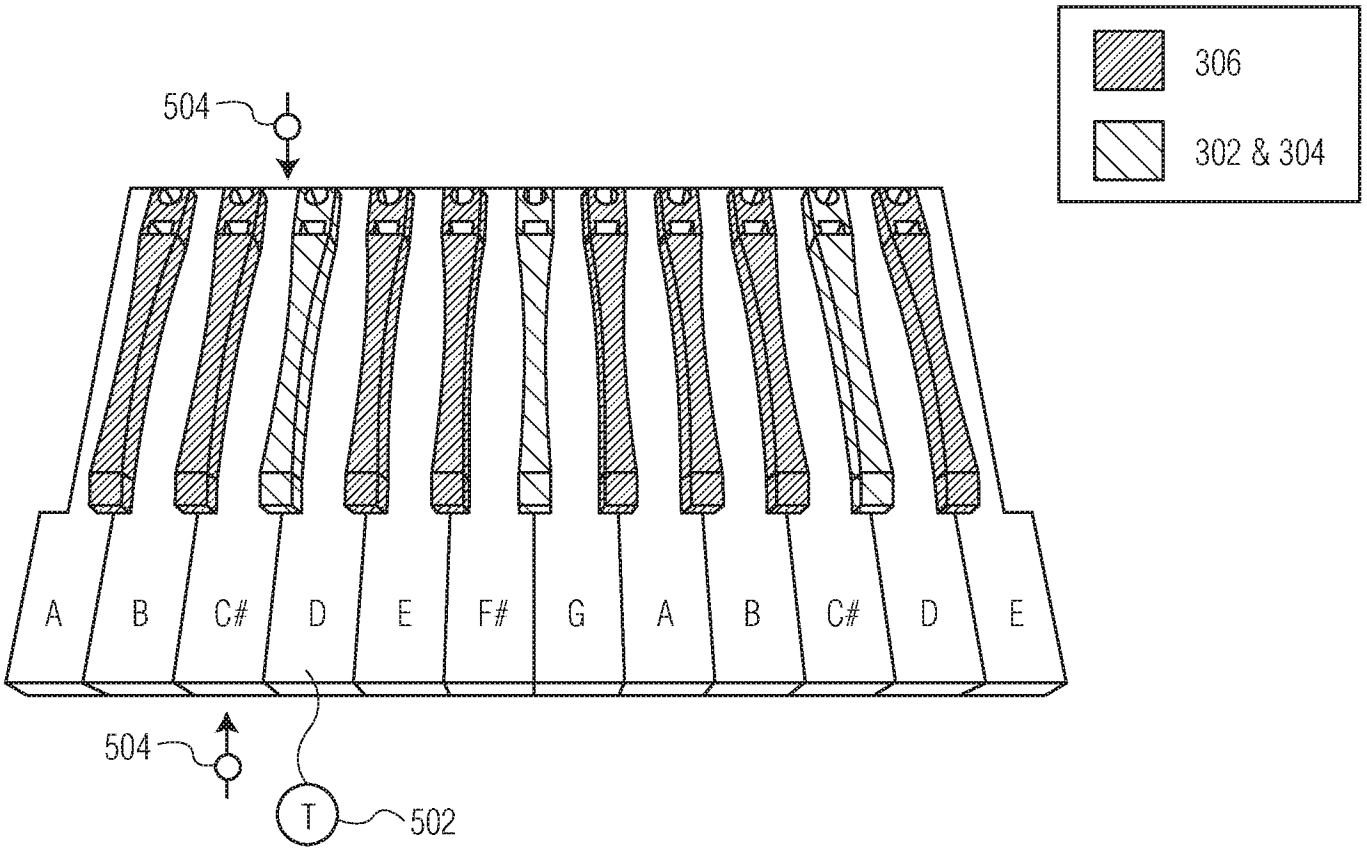
Figure 5D:
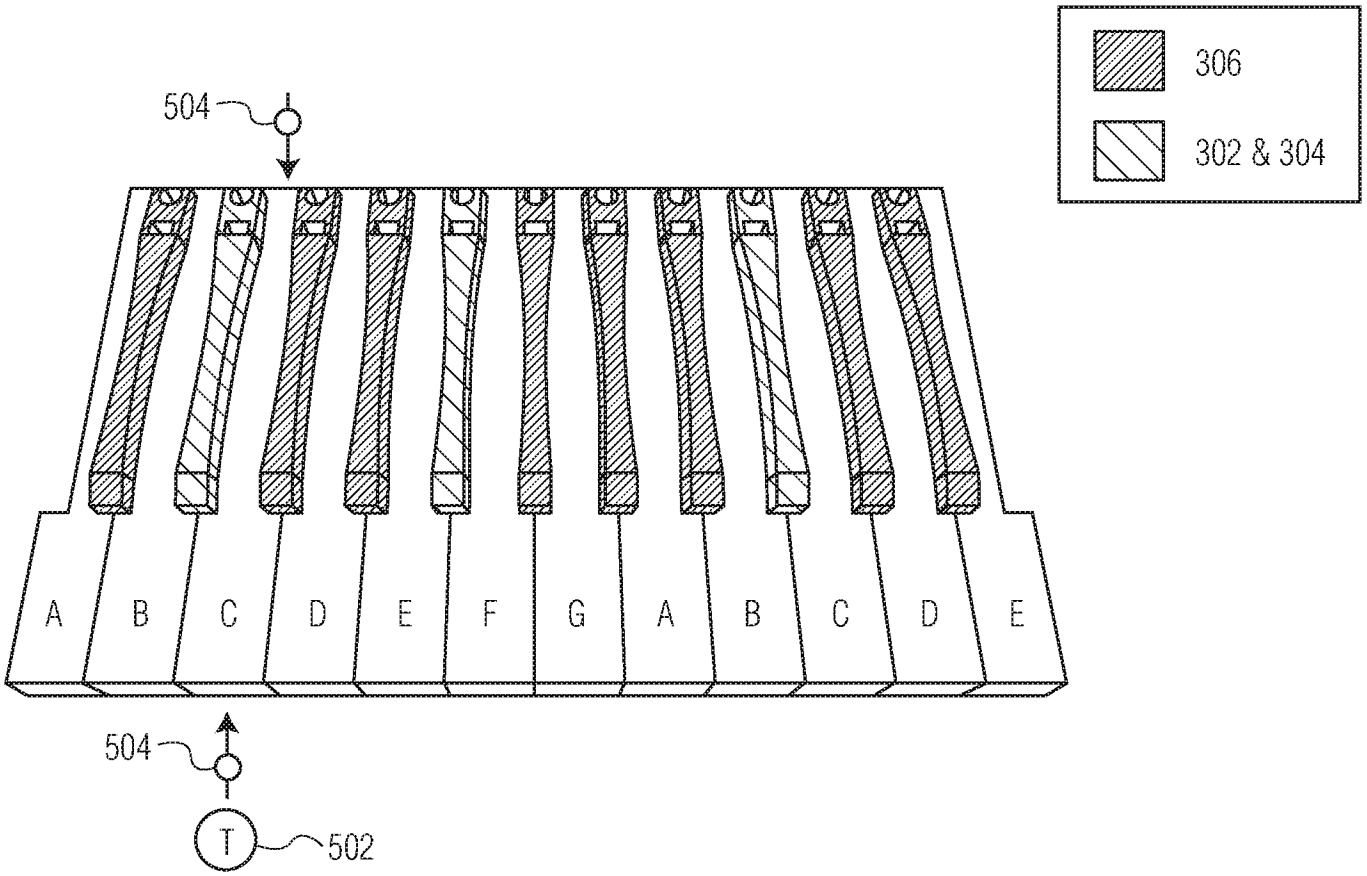

The first example, detailed in FIGS. 5A-5D, begins by showing the keyboard 100 at Unison (FIG. 5A) with C Major as the key signature and tonic 502 (marked by the encircled T) and unity key 504 (marked by the dots and arrows) both being C. Next, the key signature is changed to G Major. FIG. 5B shows that unity key 504 remains a C while the tonic 502 shifts to G. Then, when the key signature is changed to D Major, unity key 504 becomes C# (FIG. 5C). Upon modulating the key signature back to C Major (from D Major via G Major and C Major), tonic 502 and unity key 504 once again are both C (FIG. 5D). This is because the cumulative signature numbers never go above 6, or below −6. In other words, C Major to G Major=+1; G Major to D Major=+1; D Major to C Major=−2 for a cumulative total of 0 (+1+1−2).

Figure 6A:
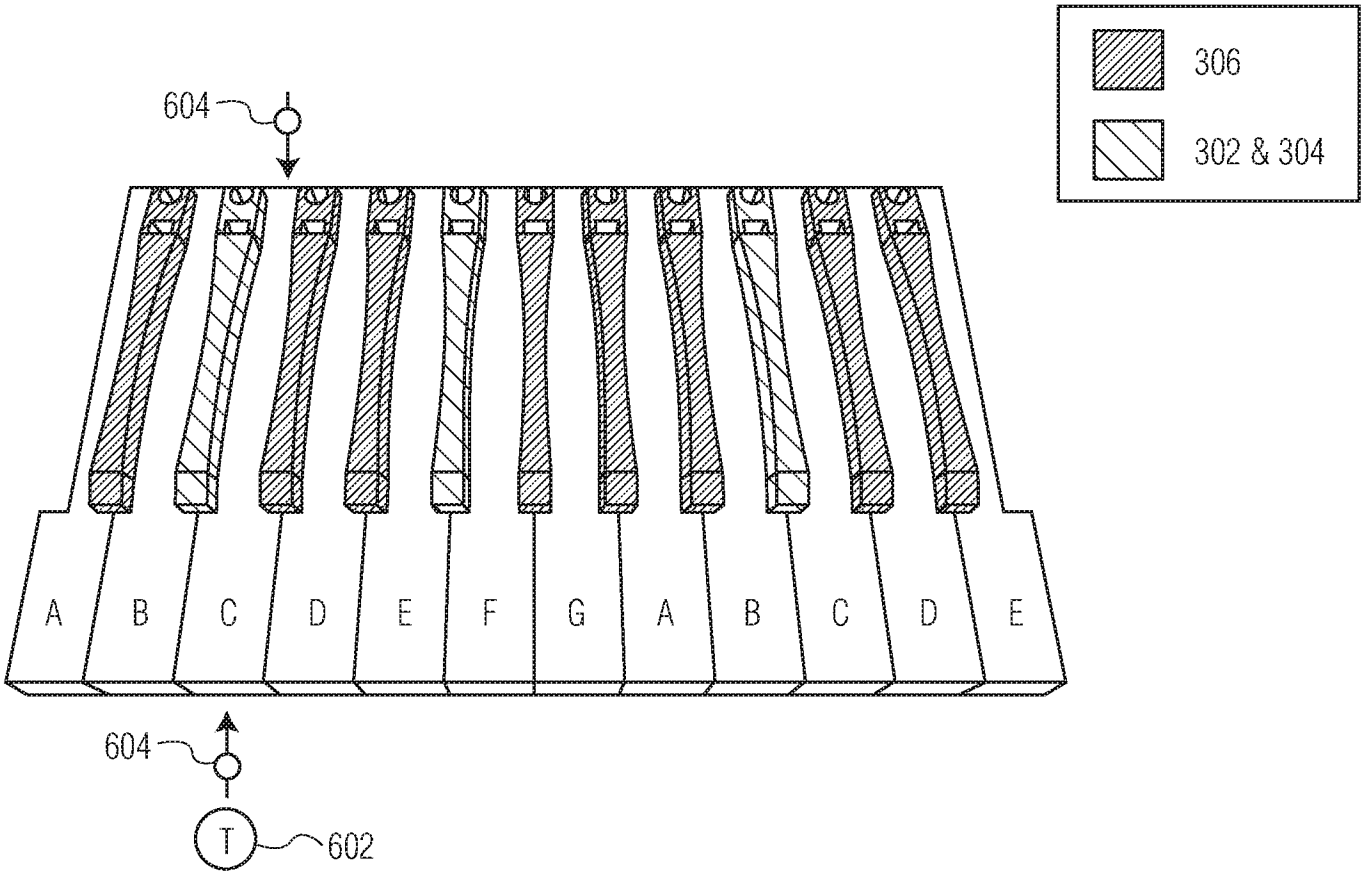
FIGS. 6A, 6B, 6C and 6D are example overhead perspective view diagrams of exemplary embodiments of a modulating keyboard illustrating example note assignments before and after various relative key transpositions where the unity key and tonic key do not correspond to each other after modulation, according to aspects of the present disclosure.
Figure 6B:
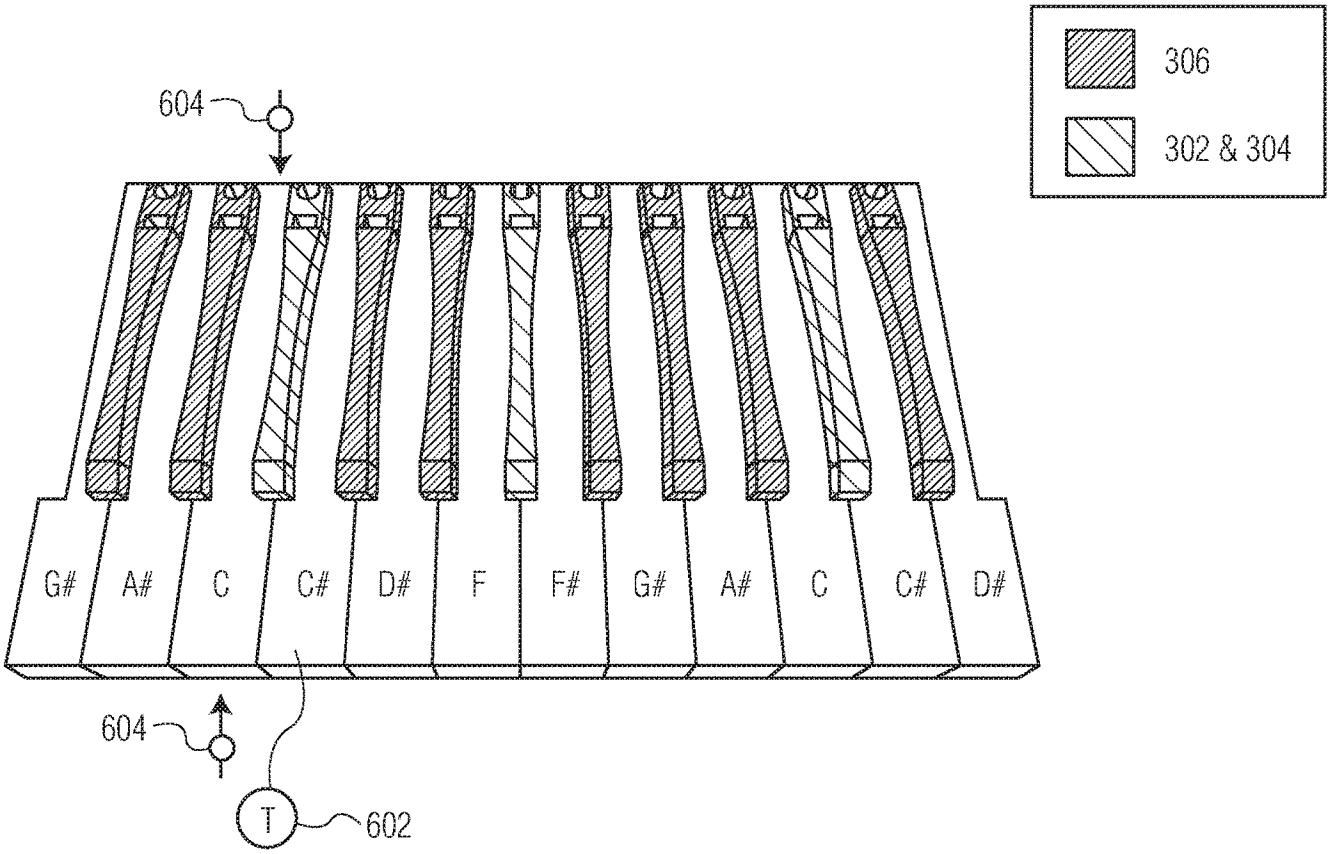
Figure 6C:
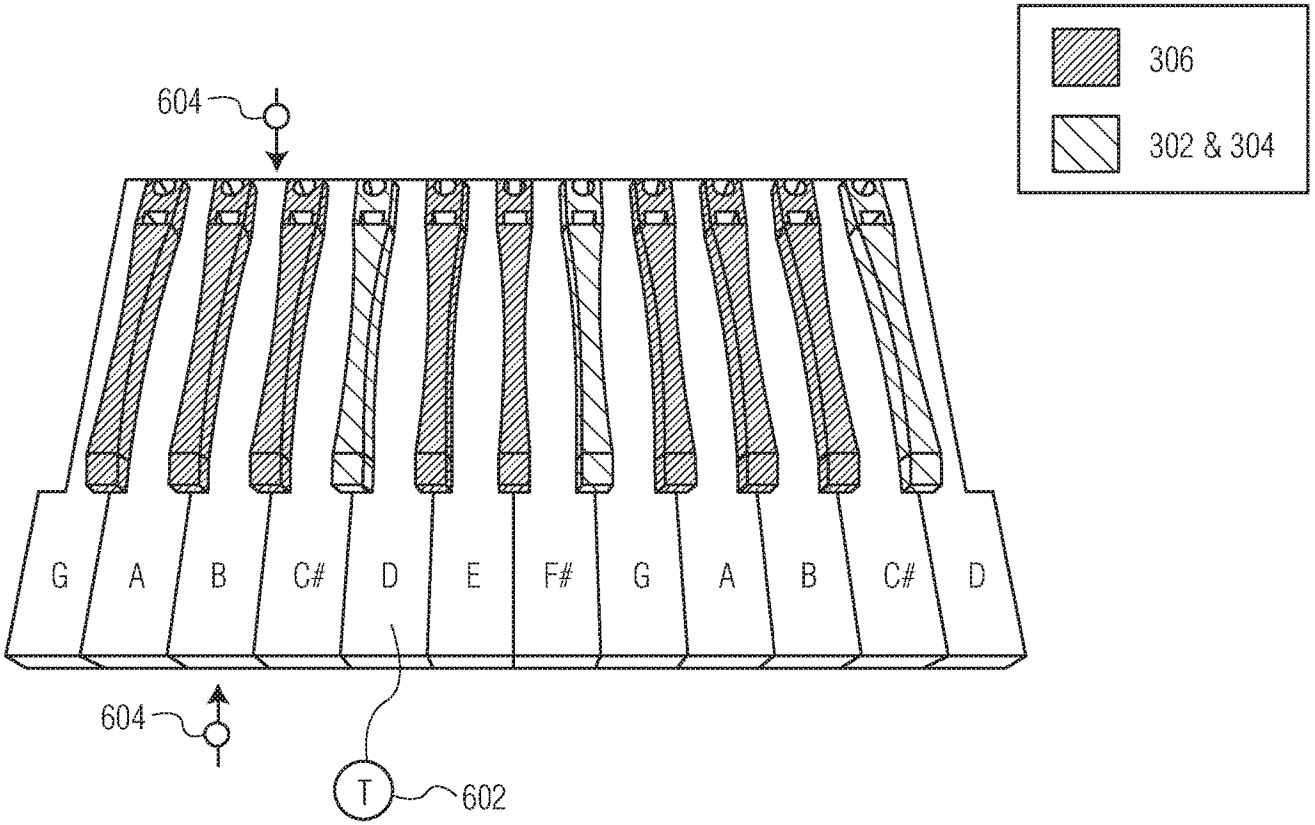
Figure 6D:
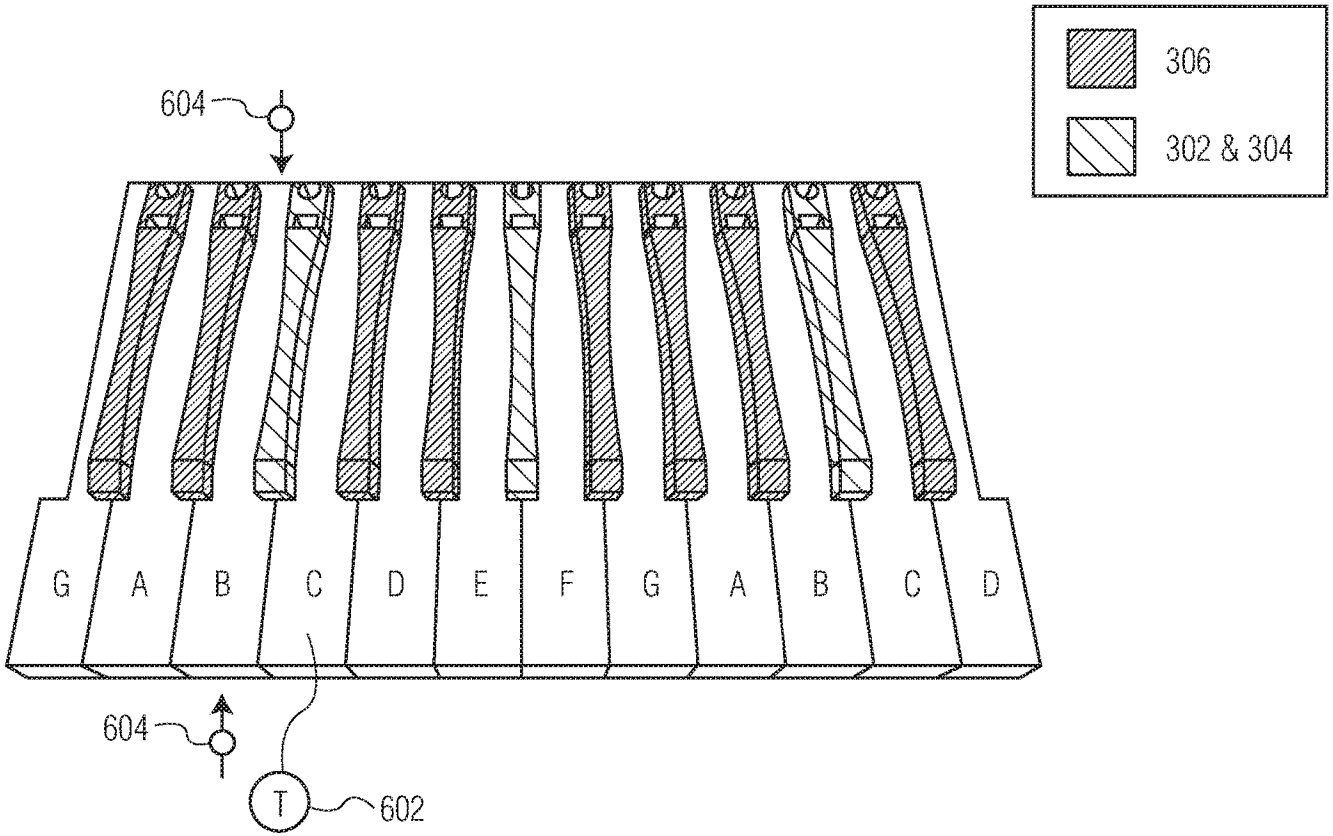

The second example, shown in FIGS. 6A-6D, begins in FIG. 6A similarly as the first example (FIG. 5A), with tonic 602 and unity 604 at unison. Next, the key signature is changed to C# Major. FIG. 6B shows that unity key 604 remains a C while tonic 602 shifts to C#. As shown in FIG. 6C, when the key signature is changed to D Major, unity key 604 becomes B. Lastly, upon modulating back to C Major (from D Major via C# Major and C Major), tonic 602 does not correspond to unity key 604 (FIG. 6D). Thus, in the example shown in FIGS. 6A-6D, the layout of keyboard 100 is changed relative to unity key 602. This is due to the cumulative signature numbers totaling −12 (which is less than −6). In other words, C Major to C# Major=−5; C# Major to D Major=−5; D Major to C Major=−2 for a total of −12 (−5−5−2). This second example (FIGS. 6A-6D), therefore, shows that taking different paths to the same key signature from the same starting point may result in the layout of the modulating keyboard 100 being different.

An example third way to relatively transpose modulating keyboard 100 may include sending a MIDI signal to DTI interface 220 via MIDI I/O interface 214. This would allow remote devices such as sequencers and other MIDI drivers to induce a relative transposition change to instrument 200. For example, if a MIDI driver is coupled to the transposition MIDI input, and the D key is selected on the driver, the selection may cause instrument 200 to relatively transpose to D major, or to a target key programmed to occur at a certain time triggered by a sequencer.

In some examples, when modulating keyboard 100 transposes relatively, light sources in second keys 106 may indicate where the tonic and subdominant scale degrees of the target key signature are positioned. For example, moving from the key of C major to the key of D major would cause the light source immediately to the left of the C first key to turn on and the light immediately to the left of the D first key to turn off showing that D is now the tonic. Also, first keys 104 that once played F and C (when keyboard 100 was in C major) will now play F# and C# (in the D major key signature) respectively.

Systems and methods of the present disclosure may include and/or may be implemented by one or more specialized computers or other suitable components including specialized hardware and/or software components. For purposes of this disclosure, a specialized computer may be a programmable machine capable of performing arithmetic and/or logical operations and specially programmed to perform the functions described herein. In some embodiments, computers may comprise microcontrollers, processors, memories, data storage devices, and/or other commonly known or novel components. These components may be connected physically or through network or wireless links. Computers may also comprise software which may direct the operations of the aforementioned components. Computers may be referred to with terms that are commonly used by those of ordinary skill in the relevant arts, such as servers, personal computers (PCs), mobile devices, and other terms. It will be understood by those of ordinary skill that those terms used herein are interchangeable, and any special purpose computer capable of performing the described functions may be used.

Computers may be linked to one another via one or more networks. A network may be any plurality of completely or partially interconnected computers wherein some or all of the computers are able to communicate with one another. It will be understood by those of ordinary skill that connections between computers may be wired in some cases (e.g., via wired Transmission Control Protocol (TCP) connection or other wired connection) and/or may be wireless (e.g., via a WiFi network connection). Any connection through which at least two computers may exchange data can be the basis of a network. Furthermore, separate networks may be able to be interconnected such that one or more computers within one network may communicate with one or more computers in another network. In such a case, the plurality of separate networks may optionally be considered to be a single network.

The term "computer" shall refer to any electronic device or devices, including those having capabilities to be utilized in connection with an electronic musical keyboard instrument, such as any device capable of receiving, transmitting, processing and/or using data and information. The computer may comprise, for example, a microcontroller, a processor, a microprocessor, a personal computer, such as a laptop, tablet, desktop or workstation, a server, an electronic wired or wireless device, such as for example, a cellular telephone, a personal digital assistant, a smartphone, a personal media player device, a gaming system, a wearable device, an electronic book reader, a set-top box, an application specific device or any other computing and/or communication device.

The term "computer-readable storage medium" should be taken to include a single medium or multiple media that store one or more sets of instructions. The term "computer-readable storage medium" shall also be taken to include any medium that is capable of storing or encoding a set of instructions for execution by the machine and that causes the machine to perform any one or more of the methodologies of the present disclosure.

FIG. 10 illustrates a functional block diagram of a machine in the example form of computer system 1000 within which a set of instructions for causing the machine to perform any one or more of the methodologies, processes or functions discussed herein may be executed. In some examples, the machine may be connected (e.g., networked) to other machines as described above. The machine may operate in the capacity of a server or a client machine in a client-server network environment, or as a peer machine in a peer-to-peer (or distributed) network environment. The machine may be any special-purpose machine capable of executing a set of instructions (sequential or otherwise) that specify actions to be taken by that machine for performing the functions describe herein. Further, while only a single machine is illustrated, the term "machine" shall also be taken to include any collection of machines that individually or jointly execute a set (or multiple sets) of instructions to perform any one or more of the methodologies discussed herein. In some examples, MIDI generator 202, modulator system 204, key indication controller 206, relative modulation user interface 208, memory 216, relative transposition mapping tables 218 and/or modulating keyboard 100 (FIG. 2) may be implemented by the example machine shown in FIG. 10 (or a combination of two or more of such machines).

Example computer system 1000 may include processing device 1002, memory 1006, data storage device 1010, one or more communication interfaces 1012, one or more output devices 1014, user interface 1016 and one or more input devices 1018, which may communicate with each other via data and control bus 1020.

Processing device 1002 may include, without being limited to, a microcontroller, a microprocessor, a central processing unit, an application specific integrated circuit (ASIC), a field programmable gate array (FPGA), a digital signal processor (DSP) and/or a network processor. Processing device 1002 may be configured to execute processing logic 1004 for performing the operations described herein. In general, processing device 1002 may include any suitable special-purpose processing device specially programmed with processing logic 1004 to perform the operations described herein.

Memory 1006 may include, for example, without being limited to, at least one of a read-only memory (ROM), a random access memory (RAM), a flash memory, a dynamic RAM (DRAM) and a static RAM (SRAM), storing computer-readable instructions 1008 executable by processing device 1002. In general, memory 1006 may include any suitable non-transitory computer readable storage medium storing computer-readable instructions 1008 executable by processing device 1002 for performing the operations described herein. Although one memory device 1008 is illustrated in FIG. 10, in some examples, computer system 1000 may include two or more memory devices (e.g., dynamic memory and static memory).

Computer system 1000 may include communication interface device 1012, for direct communication with other computers (including wired and/or wireless communication) and/or for communication with a network. The term "network" shall refer to any type of network or networks, including those capable of being utilized in connection with the electronic musical keyboard instrument 200 described herein, such as, for example, any public and/or private networks, including, for instance, the internet, an intranet, or an extranet, any wired or wireless networks (e.g., local area networks, cellular networks, satellite networks) or combinations thereof. Communication interface device 1012 may include, for example, one or more communication ports and a network controller for facilitating communications with one or more other computing devices via the communication port(s). The communication port(s) may support communications using any of a variety of protocols. In some examples, communication interface(s) 1012 may include MIDI I/O interface 214 (FIG. 2). Non-limiting examples of communications protocols include Transmission Control Protocol/Internet Protocol (TCP/IP), user datagram protocol (UDP), protocols operating in various layers of the Open System Interconnection (OSI) model, file transfer protocol (FTP), MIDI, plug and play (including universal plug and play (UpnP)), Network File System (NFS) and Common Internet File System ("CIFS").

In some examples, computer system 1000 may include one or more output devices 1014. In some examples, output device(s)_1014 may include a key indication driver for controlling the indication(s) of second keys 306 of keyboard 100 (FIG. 1). In some examples, output device(s) 1014 may include a keyboard controller interface for controlling one or more operational characteristics of keyboard in response to user input via user interface 1016. In some non-limiting examples, output device(s) 1014 may include a graphics processing unit for communication with a display device and/or an audio processing unit for communication with one or more speakers.

In some examples, computer system 1000 may include user interface 1016 to select various user interface options (such as those that may be used to control relative transposition in connection with FIG. 2 and in accordance with the description herein). In some examples, user interface 1016 may comprise relative modulation user interface 208. In some examples, user interface 1016 may also include other user interface devices (e.g., an alphanumeric input device, a cursor control device, a touch input device, pen, etc.) for controlling other operational characteristics of modulating keyboard 100 (such as volume, instrument selection, pitch bend, sustain, etc.).

In some examples, computer system 1000 may include one or more input devices 1018, which may be configured to communicate with external devices. In some examples, input device(s) 1018 may include an interface for receiving input signals from modulating keyboard 100 (FIG. 2). In some examples, the interface may include MIDI generator 202 (FIG. 2). In some non-limiting examples, input device(s) 1018 may include a serial interface controller and/or a parallel interface controller.

In some examples, computer system 1000 may include data storage device 1010 storing instructions (e.g., software) for performing any one or more of the functions described herein. Data storage device 1010 may include any suitable non-transitory computer-readable storage medium, including, without being limited to, solid-state memories, optical media and magnetic media.

While the present disclosure has been discussed in terms of certain embodiments, it should be appreciated that the present disclosure is not so limited. The embodiments are explained herein by way of example, and there are numerous modifications, variations and other embodiments that may be employed that would still be within the scope of the present disclosure.

What is claimed:

1. A method for transposing an electronic keyboard, the method comprising:

assigning, by a microcontroller coupled to the electronic keyboard, for a current key signature, note values to each of a plurality of first keys of the electronic keyboard, such that notes associated with the current key signature are assigned to the plurality of first keys, the electronic keyboard including the plurality of first keys alternating with a plurality of second keys;

assigning, by the microcontroller, for the current key signature, note values to each of the plurality of second keys of the electronic keyboard, such that notes not in the key signature are assigned to the plurality of second keys;

receiving a selection indicating a transposition to a target key signature; and modifying, by the microcontroller, responsive to the selection, note values assigned to each of the first keys and the second keys according to a relative transposition mapping, to shift one or more notes that the current key signature and the target key signature do not have in common, and such that notes associated with the target key signature are assigned to the plurality of first keys.

2. The method of claim 1, wherein the plurality of first keys and the plurality of second keys correspond to at least one octave, the method further comprising assigning, for each octave, a null note value to each of two keys among the plurality of second keys.

3. The method of claim 2, the method further comprising indicating, by at least one of the two keys, for each octave, a position of at least one note in a scale associated with the key signature.

4. The method of claim 2, the method further comprising:

indicating, for each octave, a playability of remaining keys among the plurality of second keys; and indicating, for each octave, a non-playability of the two keys.

5. The method of claim 1, wherein the plurality of first keys and the plurality of second keys correspond to at least one octave having a fourteen note scale, the method further comprising converting one or more note values associated with one or more key events for the fourteen note scale to one or more note values for a twelve note scale.

6. The method of claim 1, wherein the one or more notes are shifted by no more than one semitone when assigned to the target key signature.

7. The method of claim 1, wherein a tonic of the target key signature is assigned to a different first key among the plurality of first keys with respect to the current key signature, or is assigned to a same first key among the plurality of first keys with respect to the current key signature, responsive to the modification of the note values.

8. A non-transitory computer-readable storage medium programmed to include instructions that, when executed by one or more processing devices, cause the one or more processing devices to perform functions including:

assigning, for a current key signature, note values to each of a plurality of first keys of an electronic keyboard, such that notes associated with the current key signature are assigned to the plurality of first keys, the electronic keyboard including the plurality of first keys alternating with a plurality of second keys;

assigning, for the current key signature, note values to each of the plurality of second keys of the electronic keyboard, such that notes not in the key signature are assigned to the plurality of second keys;

receiving a selection indicating a transposition to a target key signature; and modifying, responsive to the selection, note values assigned to each of the first keys and the second keys according to a relative transposition mapping, to shift one or more notes that the current key signature and the target key signature do not have in common, and such that notes associated with the target key signature are assigned to the plurality of first keys.

9. An electronic keyboard musical instrument comprising:

an electronic keyboard including a plurality of first keys alternating with a plurality of second keys; and a modulator system comprising a microcontroller, coupled to the electronic keyboard, configured to assign note values to each of the first keys and the second keys such that, for a current key signature, notes associated with the current key signature are assigned to the plurality of first keys and notes not in the current key signature are assigned to the plurality of second keys, the modulator system further configured to:

receive a selection indicating a transposition to a target key signature; and modify, responsive to the selection, note values assigned to each of the first keys and the second keys according to a relative transposition mapping, to shift one or more notes that the current key signature and the target key signature do not have in common, and such that notes associated with the target key signature are assigned to the plurality of first keys.

10. The instrument of claim 9, wherein at least one key among the plurality of second keys is configured to indicate a position of at least one note in a scale associated with a key signature among the current key signature and the target key signature.

11. The instrument of claim 9, wherein each second key is configured in a non-rectangular shape.

12. The instrument of claim 11, wherein each second key is configured in an hourglass shape.

13. The instrument of claim 9, wherein the plurality of first keys and the plurality of second keys correspond to at least one octave, and the modulator system is configured to assign, for each octave, a null note value to each of two keys among the plurality of second keys.

14. The instrument of claim 13, wherein, for each octave, remaining keys among the plurality of second keys are configured to indicate a playability, and the two keys are configured to indicate a non-playability.

15. The instrument of claim 14, further comprising a key indication controller coupled to the modulator system and to a plurality of light sources associated with the plurality of second keys, the key indication controller controlling the plurality of light sources to indicate the playability of the remaining keys and the non-playability of the two keys.

16. The instrument of claim 9, further comprising a Musical Instrument Digital Interface (MIDI) generator, coupled to the plurality of first keys and the plurality of second keys, the MIDI generator indicating one or more note values among each key due to a respective key event.

17. The instrument of claim 16, wherein the plurality of first keys and the plurality of second keys correspond to at least one octave having a fourteen note scale, the modulator system configured to convert the one or more note values received from the MIDI generator for the fourteen note scale to one or more note values for a twelve note scale.

18. The instrument of claim 17, wherein the relative transposition mapping performs a relative transposition of note assignments for the first keys and the second keys from the current key signature to the target key signature, such that notes assigned for the current key signature are shifted by no more than one semitone when assigned to the target key signature.

19. The instrument of claim 9, further comprising a user interface configured to receive a selection of at least one of the target key signature and an interval for a relative transposition.

20. The instrument of claim 9, further comprising a communication interface configured for a plug and play communication protocol.

* * * * *